US009679432B2

(12) United States Patent
Mizoro et al.

(10) Patent No.: US 9,679,432 B2
(45) Date of Patent: Jun. 13, 2017

(54) PAPER SHEET STACKING MECHANISM AND PAPER SHEET HANDLING DEVICE

(71) Applicant: GLORY LTD., Himeji-shi, Hyogo (JP)

(72) Inventors: Tsuguo Mizoro, Himeji (JP); Kazuhiko Hasegawa, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 14/904,866

(22) PCT Filed: Jun. 18, 2014

(86) PCT No.: PCT/JP2014/066106
§ 371 (c)(1),
(2) Date: Jan. 13, 2016

(87) PCT Pub. No.: WO2015/012027
PCT Pub. Date: Jan. 29, 2015

(65) Prior Publication Data

US 2016/0163143 A1 Jun. 9, 2016

(30) Foreign Application Priority Data

Jul. 24, 2013 (JP) ..... 2013-153579

(51) Int. Cl.
*B65H 29/54* (2006.01)
*G07D 11/00* (2006.01)
(Continued)

(52) U.S. Cl.
CPC ..... *G07D 11/0033* (2013.01); *B65H 29/40* (2013.01); *B65H 29/62* (2013.01);
(Continued)

(58) Field of Classification Search
CPC ..... B65H 29/40; B65H 2404/2611; B65H 2404/265; B65H 2404/262; B65H 2301/4474
See application file for complete search history.

(56) References Cited

U.S. PATENT DOCUMENTS 4,629,174 A * 12/1986 Wakisaka ..... B65H 29/40 271/186
4,915,371 A * 4/1990 Quinton ..... B65H 29/40 271/187
5,775,682 A * 7/1998 Hosking ..... B65H 29/40 271/119

FOREIGN PATENT DOCUMENTS

JP 61-33457 A 2/1986
JP 61-148857 U 9/1986
(Continued)

OTHER PUBLICATIONS

Written Opinion of the International Searching Authority (PCT/JP2014/066106) (5 pages—dated Sep. 22, 2014).
(Continued)

*Primary Examiner* — Howard Sanders
(74) *Attorney, Agent, or Firm* — Renner, Kenner, Greive, Bobak, Taylor & Weber

(57) ABSTRACT

A paper sheet stacking mechanism 50 includes a stacking wheel 52, a roller 54 that is disposed outward from the stacking wheel 52 so as to be coaxially aligned with the stacking wheel 52 and that is rotatable about a shaft 53 at a greater angular velocity than that of the stacking wheel 52, and a transport unit that is configured to transport a paper sheet to the gap between two adjacent vanes 52*b* of the stacking wheel 52. The transport unit is located such that a discharge position is disposed outward from the outer periphery of the base 52*a* of the stacking wheel 52 and inward of the circular region defined by the tips of the vanes
(Continued)

52*b* of the stacking wheel 52 during the rotation of the stacking wheel 52, when viewed in the axial direction of the shaft 53 of the stacking wheel 52.

19 Claims, 14 Drawing Sheets

(51) Int. Cl.
*B65H 29/40* (2006.01)
*B65H 29/62* (2006.01)
*B65H 31/24* (2006.01)

(52) U.S. Cl.
CPC ..... *B65H 31/24* (2013.01); *G07D 11/0021* (2013.01); *B65H 2301/4212* (2013.01); *B65H 2301/4474* (2013.01); *B65H 2404/1531* (2013.01); *B65H 2404/262* (2013.01); *B65H 2404/265* (2013.01); *B65H 2404/2611* (2013.01); *B65H 2405/1117* (2013.01); *B65H 2405/324* (2013.01); *B65H 2405/332* (2013.01); *B65H 2405/3321* (2013.01); *B65H 2701/1912* (2013.01)

(56) References Cited

FOREIGN PATENT DOCUMENTS

| | | | |
|---|---|---|---|
| JP | 62-136473 | A | 6/1987 |
| JP | 2011-180732 | A | 9/2011 |
| JP | 2012-66909 | A | 4/2012 |

OTHER PUBLICATIONS

Chinese Office Action (Application No. 201480041617.6) (dated Sep. 8, 2016—6 pages).
English Translation of Chinese Office Action (Application No. 201480041617.6) (Mailing Date: Sep. 8, 2016—6 pages).
Japanese Office Action with English Translation (Application No. 2013-153579) (dated Feb. 22, 2017—8 pages).

* cited by examiner

| | DIAMETER OF STACKING WHEEL | NUMBER OF VANES | MINIMUM DISTANCE(a) | ANGLE OF VANE(b) |
|---|---|---|---|---|
| (i) PRESENT INVENTION | 45mm | 8 | 2.70mm | 155.68° |
| (ii) COMPARATIVE EXAMPLE 1 | 100mm | 16 | 7.84mm | 112.50° |
| (iii) COMPARATIVE EXAMPLE 2 | 70mm | 16 | 3.01mm | 144.84° |
| (iv) COMPARATIVE EXAMPLE 3 | 70mm | 12 | 4.39mm | 132.00° |

FIG. 8

PAPER SHEET STACKING MECHANISM AND PAPER SHEET HANDLING DEVICE

TECHNICAL FIELD

The present invention relates to a paper sheet stacking mechanism including a stacking wheel for stacking paper sheets, such as banknotes, checks, and securities, in an aligned state, and a paper sheet handling apparatus including such a paper sheet stacking mechanism.

BACKGROUND ART

Various types of paper sheet stacking mechanisms have been used which include a stacking wheel for stacking paper sheets, such as banknotes, checks, and securities in an aligned state (refer to JP2011-180732A, for example). The stacking wheel of the conventional paper sheet stacking mechanism includes vanes disposed on the outer periphery thereof at regular intervals. While the stacking wheel is rotating, each paper sheet enters the gap between two adjacent vanes of the stacking wheel and is transported by the rotation of the stacking wheel. After the front end edge of each paper sheet transported by the rotating stacking wheel comes into contact with a guide member, the paper sheet is released from the gap between the vanes and is stacked in the stacking unit in an aligned state.

SUMMARY OF INVENTION

In the conventional paper sheet stacking mechanism, a discharge position, from which a paper sheet transported from a transport unit for transporting a paper sheet to the gap between two adjacent vanes of the stacking wheel is discharged, is disposed outward from the circular region defined by the tips of the vanes of the stacking wheel. Unfortunately, the stacking wheel of such a conventional paper sheet stacking mechanism cannot certainly receive a limp paper sheet transported from the transport unit.

In addition, in the conventional paper sheet stacking mechanism, the paper sheet once received in the gap between two adjacent vanes of the stacking wheel may be thrust out of the gap between the vanes by the resilience of the paper sheet before the front end edge of the paper sheet contacts with the guide member. This leads to a failure in stacking the paper sheets in the stacking unit in an aligned state. Such a trouble may be more significant in a compact paper sheet stacking mechanism including a compact stacking wheel because the paper sheet received in the gap between the vanes of the compact stacking wheel has increased resilience.

An object of the present invention, which has been made in view of such problems, is to provide a paper sheet stacking mechanism and a paper sheet handling apparatus that can securely stack paper sheets on a stacking unit in an aligned state.

A paper sheet stacking mechanism of the present invention includes: a stacking unit which is configured to stack paper sheets in a stacked manner therein; a stacking wheel which is configured to transport paper sheets one by one to the stacking unit, the stacking wheel which includes a base rotatable in a first rotational direction about a shaft and a plurality of vanes outwardly extending from the outer periphery of the base in a second rotational direction opposite to the first rotational direction of the base, the stacking wheel which is configured to repeatedly transport a paper sheet received in a gap between two adjacent vanes among the plurality of vanes to the stacking unit; a roller which is disposed adjacent to the stacking wheel so as to be coaxial with the stacking wheel, the roller which is rotatable about the shaft at a greater angular velocity than the angular velocity of the stacking wheel; and a transport unit which faces the roller, the transport unit which is configured to transport a paper sheet to a gap between two adjacent vanes among the plurality of vanes of the stacking wheel, the transport unit which is located such that a discharge position, from which a paper sheet gripped between the roller and the transport unit is discharged, is disposed outward from the outer periphery of the base of the stacking wheel and inward of a circular region defined by tips of the plurality of vanes of the stacking wheel during rotation of the stacking wheel, when viewed from the axial direction of the shaft.

The paper sheet stacking mechanism of the present invention may further include a frictional member disposed on the outer periphery of the roller.

In this case, the frictional member may include rubber.

In the paper sheet stacking mechanism of the present invention, the transport unit may include a transport belt in partial contact with the outer periphery of the roller.

In this case, the roller may be rotated together with circulation of the transport belt.

Also, the transport belt may be located so as to limit a paper sheet being transported until a gap between two adjacent vanes among the plurality of vanes of the stacking wheel within a predetermined deviation amount.

In the paper sheet stacking mechanism of the present invention, the transport unit may include a counter roller in partial contact with the outer periphery of the roller.

In this case, the counter roller in partial contact with the outer periphery of the roller may include a plurality of rollers.

Also, the paper sheet stacking mechanism of the present invention may further include a guide unit for limiting a paper sheet being transported until a gap between two adjacent vanes among the plurality of vanes of the stacking wheel within a predetermined deviation amount.

The paper sheet stacking mechanism of the present invention may further include an auxiliary belt wound around the roller. The transport unit may include a transport belt in partial contact with the auxiliary belt, the auxiliary belt being in partial contact with the outer periphery of the roller. And a paper sheet gripped between the auxiliary belt wound around the roller and the transport belt of the transport unit may be discharged from the discharge position.

The paper sheet stacking mechanism of the present invention may further include an auxiliary belt wound around the roller. The transport unit may include a counter roller in partial contact with the auxiliary belt, the auxiliary belt being in partial contact with the outer periphery of the roller. And a paper sheet gripped between the auxiliary belt wound around the roller and the counter roller of the transport unit may be discharged from the discharge position.

Further, part of the auxiliary belt may be in partial contact with the outer periphery of the roller. And the other part of the auxiliary belt may sag from the outer periphery of the roller.

A paper sheet stacking mechanism of the present invention includes: a stacking unit which is configured to stack paper sheets in a stacked manner therein; a stacking wheel which includes a base rotatable in a first rotational direction about a shaft and a plurality of vanes outwardly extending from the outer periphery of the base in a second rotational direction opposite to the first rotational direction of the base, the stacking wheel which is configured to repeatedly transport a paper sheet received in a gap between two adjacent vanes among the plurality of vanes to the stacking unit; a roller which is disposed adjacent to the stacking wheel so as to be coaxial with the stacking wheel, the roller which is rotatable about the shaft at a greater angular velocity than the angular velocity of the stacking wheel; and a transport unit which transports a paper sheet to a gap between two adjacent vanes among the plurality of vanes of the stacking wheel, the transport unit which is located such that a discharge position, from which a paper sheet transported by the transport unit is discharged, is disposed outward from a circular region defined by tips of the plurality of vanes of the stacking wheel during rotation of the stacking wheel, when viewed from the axial direction of the shaft.

In the paper sheet stacking mechanism of the present invention, a minimum distance may be within a range of 1.5 mm to 3.0 mm between the tip of each vane of the stacking wheel and the surface of an adjacent vane.

In the paper sheet stacking mechanism of the present invention, the angle may be within a range of 150° to 180° between a straight line from the tip of each vane of the stacking wheel to the shaft of the stacking wheel and a straight line from the root of the vane attached to the base to the shaft of the stacking wheel.

In the paper sheet stacking mechanism of the present invention, the stacking wheel may include at least two stacking wheels coaxially aligned. A first auxiliary roller may be disposed between the at least two stacking wheels so as to be coaxial with the at least two stacking wheels, and the first auxiliary roller may have a diameter greater than the diameter of the base of each of the at least one stacking wheel.

In this case, the frictional coefficient between the outer periphery of the roller and a paper sheet to be stacked in the stacking unit may be greater than the frictional coefficient between the outer periphery of the first auxiliary roller and the paper sheet.

In the paper sheet stacking mechanism of the present invention, at least two stacking wheels may be coaxially aligned, second auxiliary rollers may be respectively disposed outward from the at least two stacking wheels. The second auxiliary rollers is coaxial with the at least two stacking wheels.

In this case, each of the second auxiliary rollers may have a diameter not greater than the diameter of the roller.

Further, the frictional coefficient between the outer periphery of the roller and a paper sheet to be stacked in the stacking unit may be greater than the frictional coefficient between the outer periphery of each of the second auxiliary rollers and the paper sheet.

A paper sheet handling apparatus of the present invention includes the above paper sheet stacking mechanism.

BRIEF DESCRIPTION OF DRAWING

FIGS. 7(*ii*), 7(*iii*), 7(*iv*) each illustrate the configuration of the stacking wheel of a conventional paper sheet stacking mechanism.

FIG. 8 is a table showing the properties of the stacking wheels illustrated in FIG. 7(*i*) to FIG. 7(*iv*).

FIG. 15(*a*) illustrates the position of a pressing member when no paper sheet is placed in the hopper, while FIG. 15(*b*) illustrates the position of pressing member when a large number of paper sheets are placed in the hopper.

DESCRIPTION OF EMBODIMENTS

Figure 1:
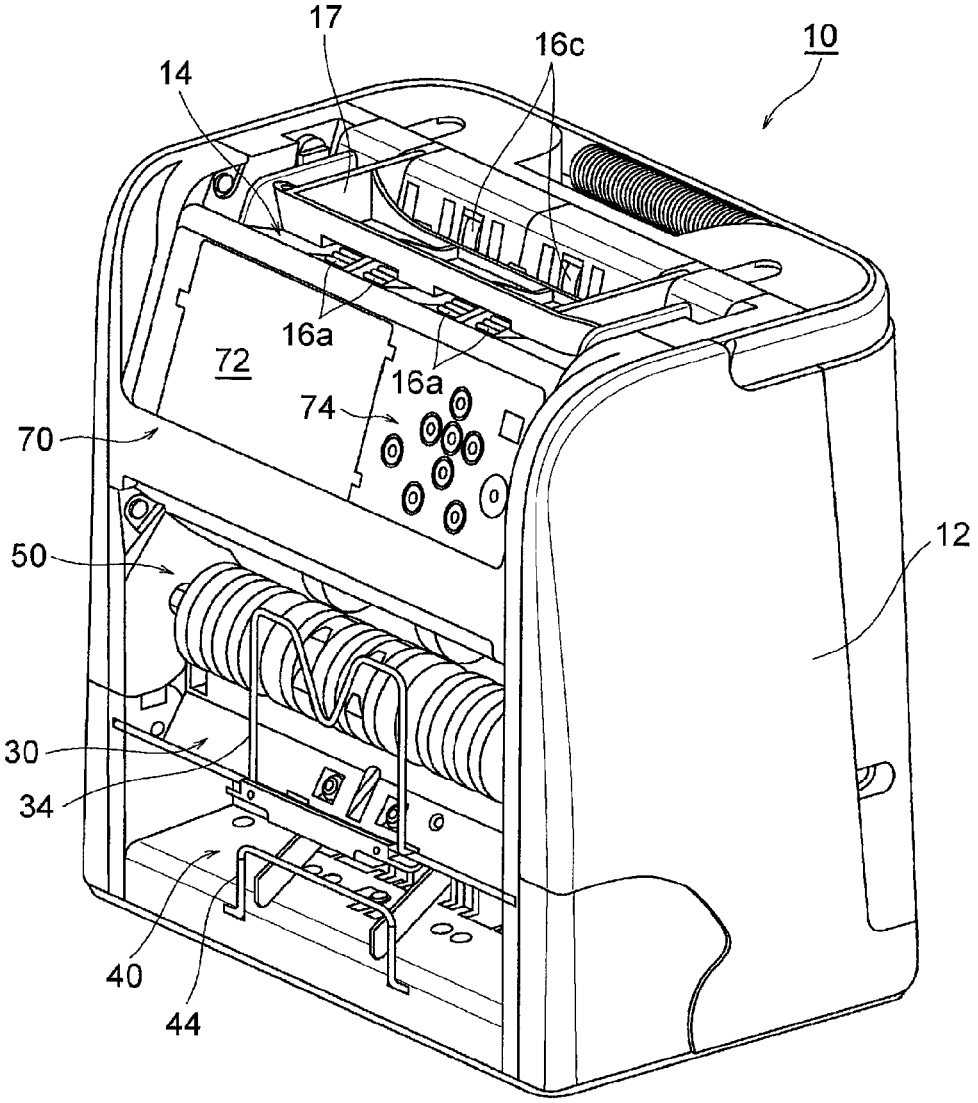
FIG. 1 is an external perspective view of a paper sheet handling apparatus according to an embodiment of the present invention.
Figure 2:
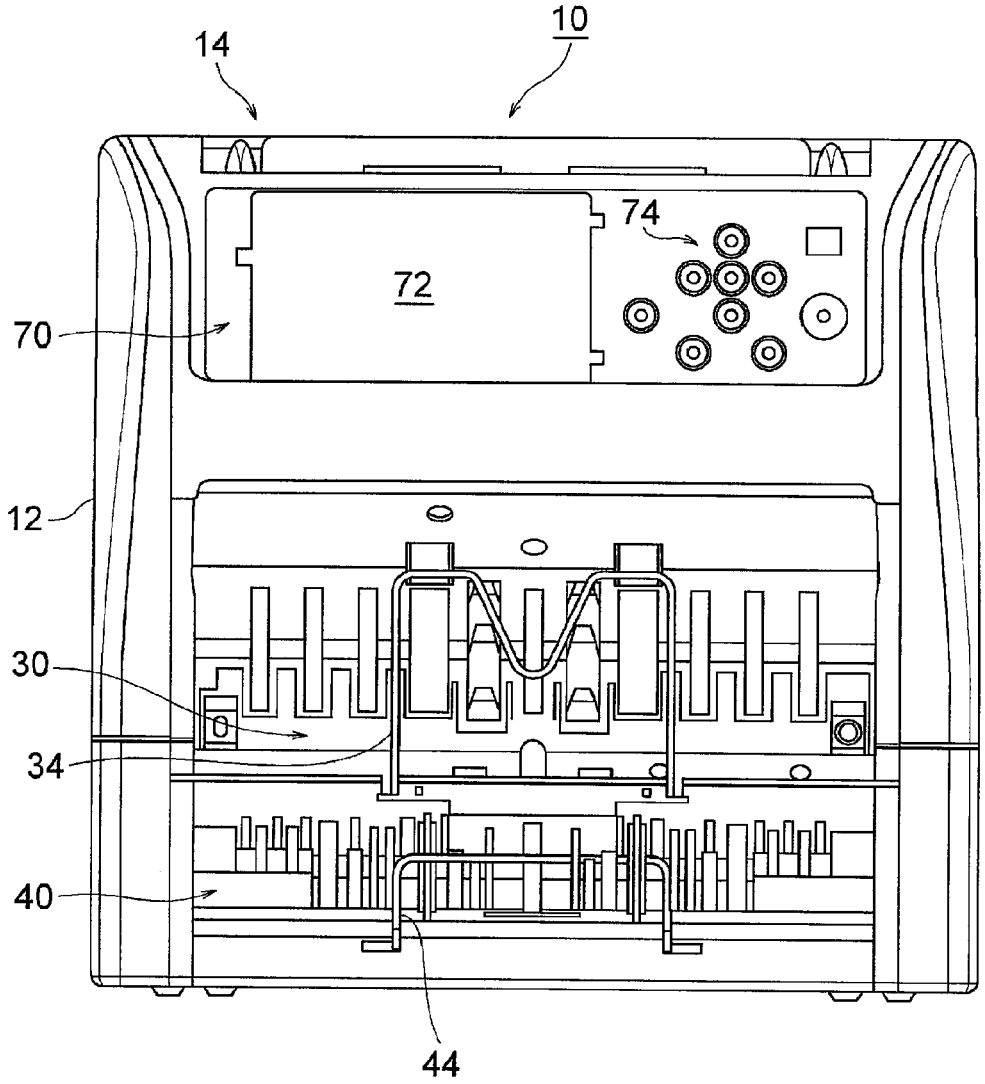
FIG. 2 is a front view of the paper sheet handling apparatus illustrated in FIG. 1.
Figure 3:
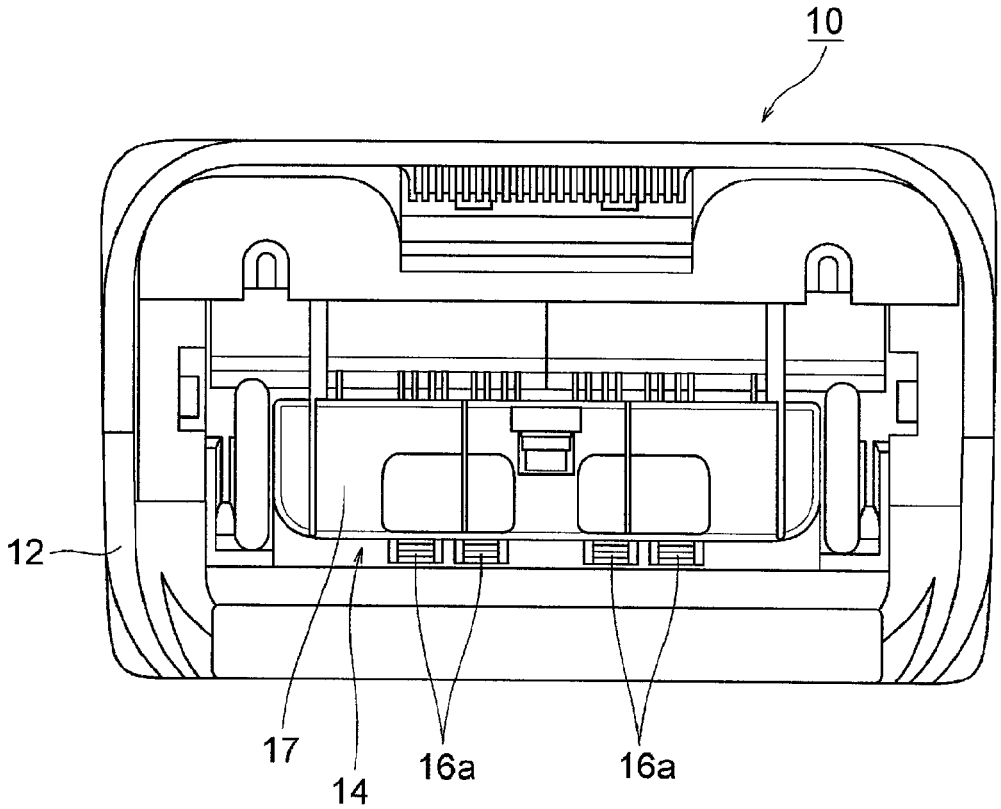
FIG. 3 is a top view of the paper sheet handling apparatus illustrated in FIG. 1, etc.
Figure 4:
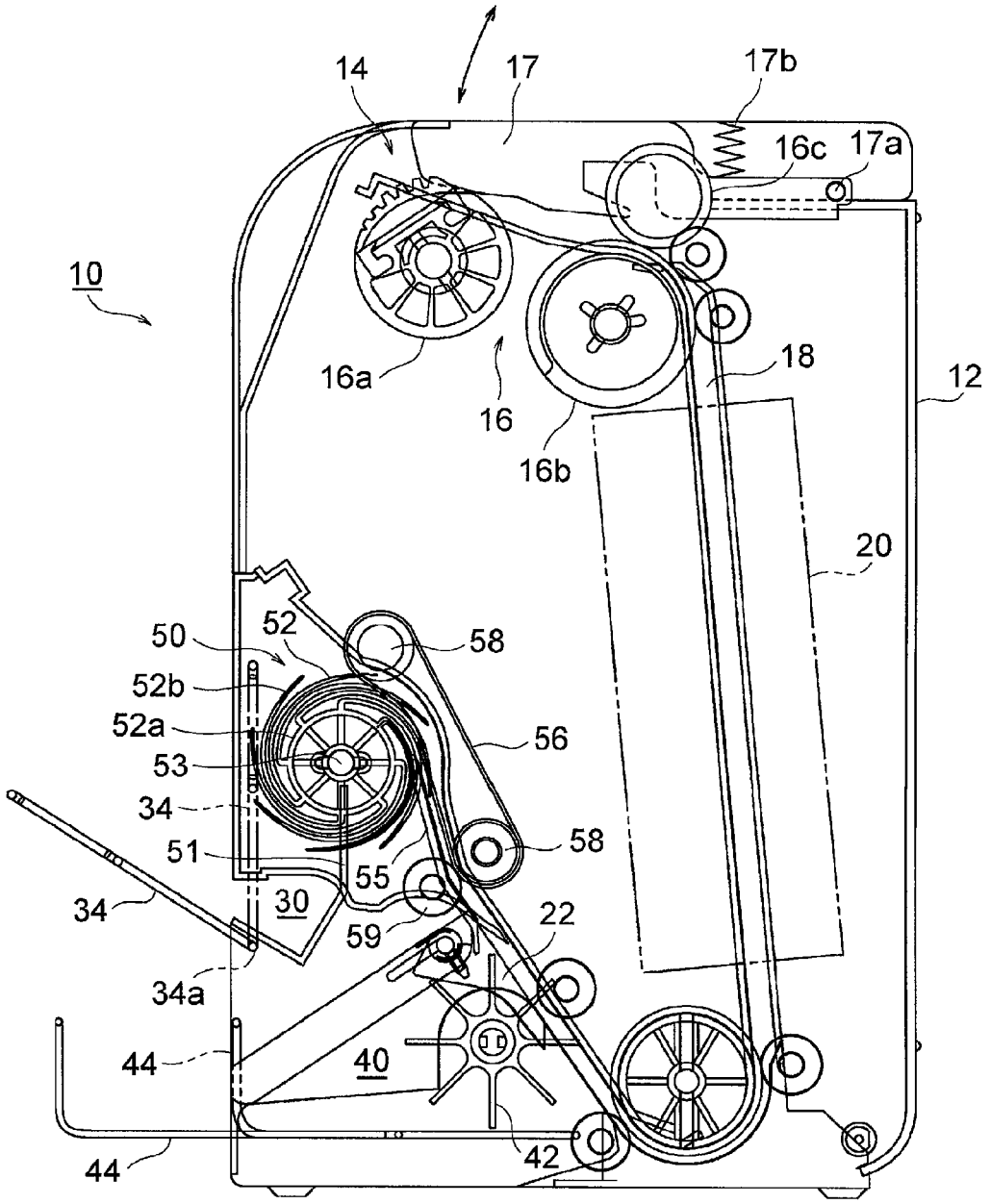
FIG. 4 is a schematic view illustrating the internal configuration of the paper sheet handling apparatus illustrated in FIG. 1, etc.
Figure 5:
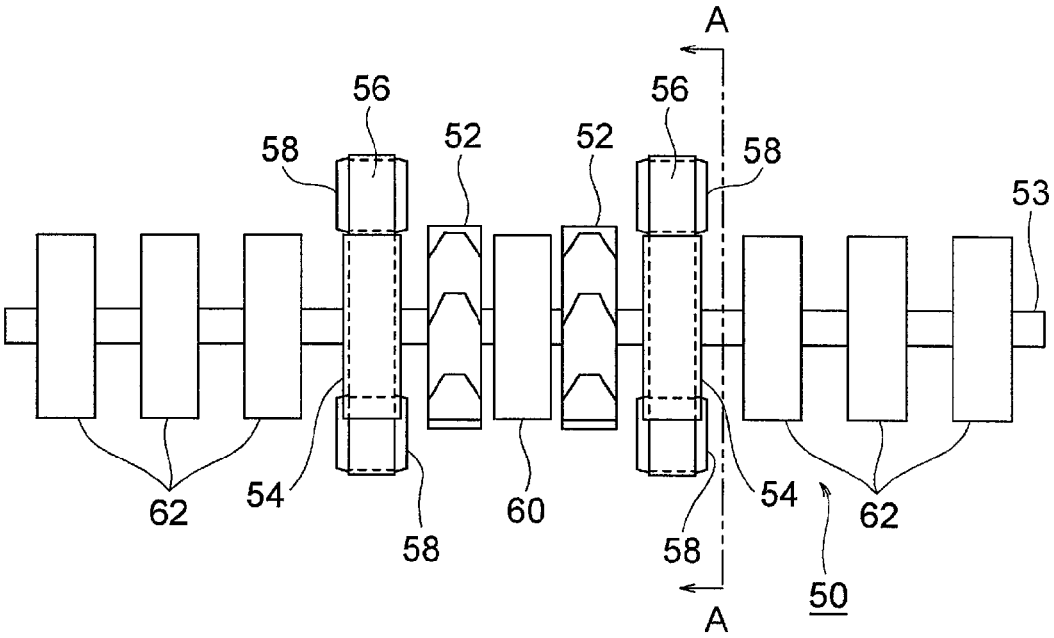
FIG. 5 illustrates the configuration of the paper sheet stacking mechanism viewed from the left side to the right side in FIG. 4.
Figure 6:
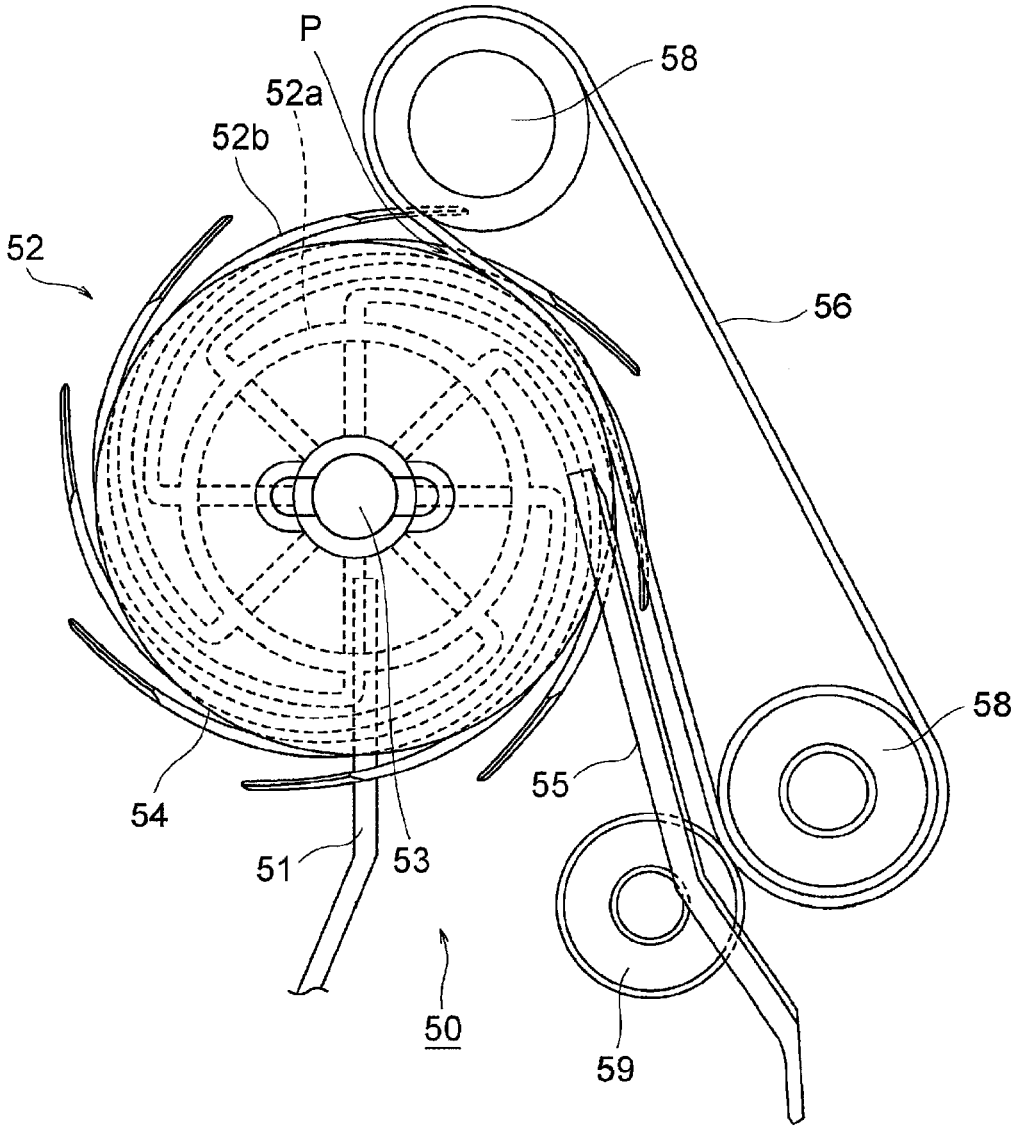
FIG. 6 is a side view of the paper sheet stacking mechanism along the arrow A-A of FIG. 5.
Figure 7:
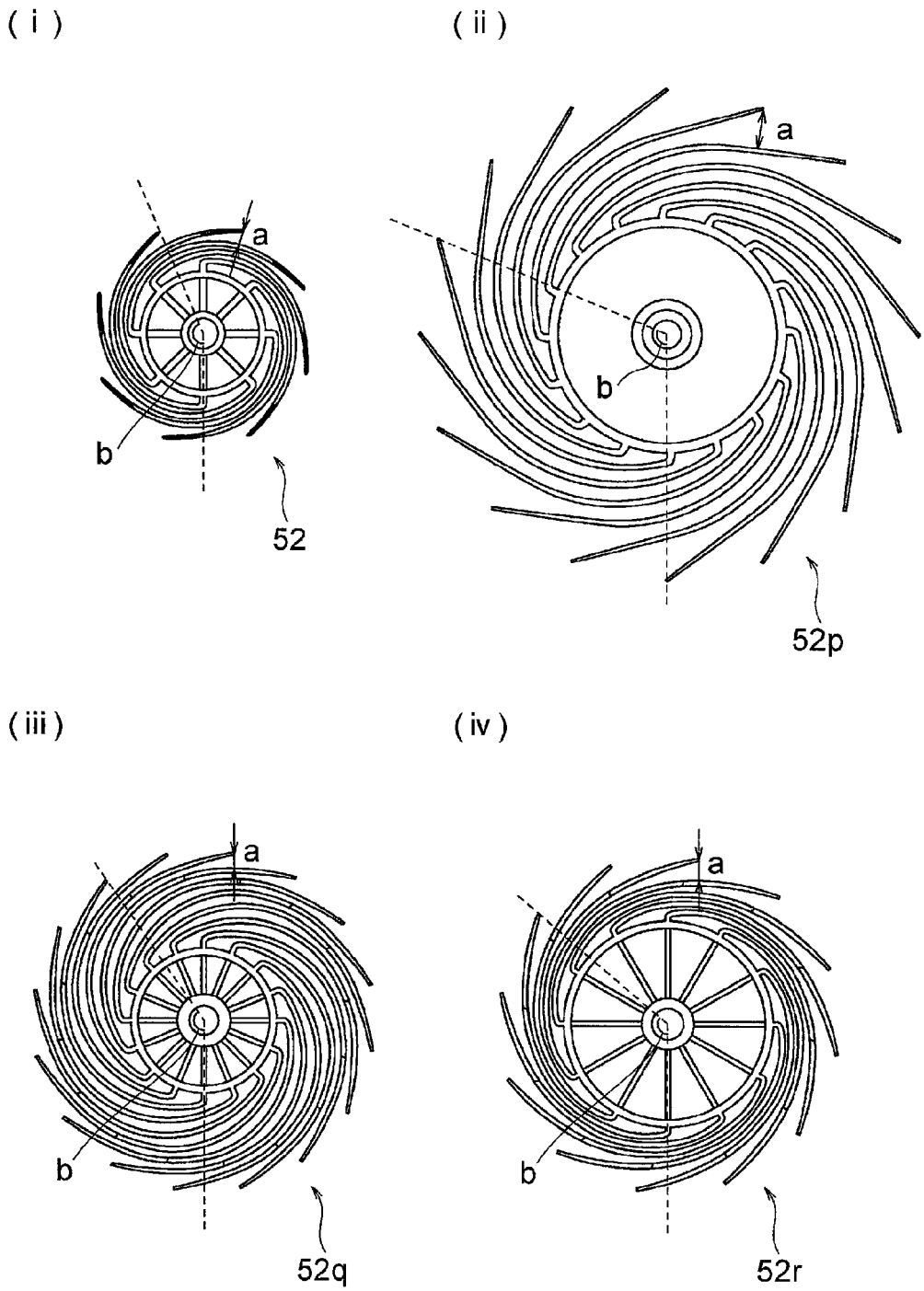
FIG. 7(*i*) illustrates the configuration of the stacking wheel of the paper sheet stacking mechanism of the present invention.
Figure 13:
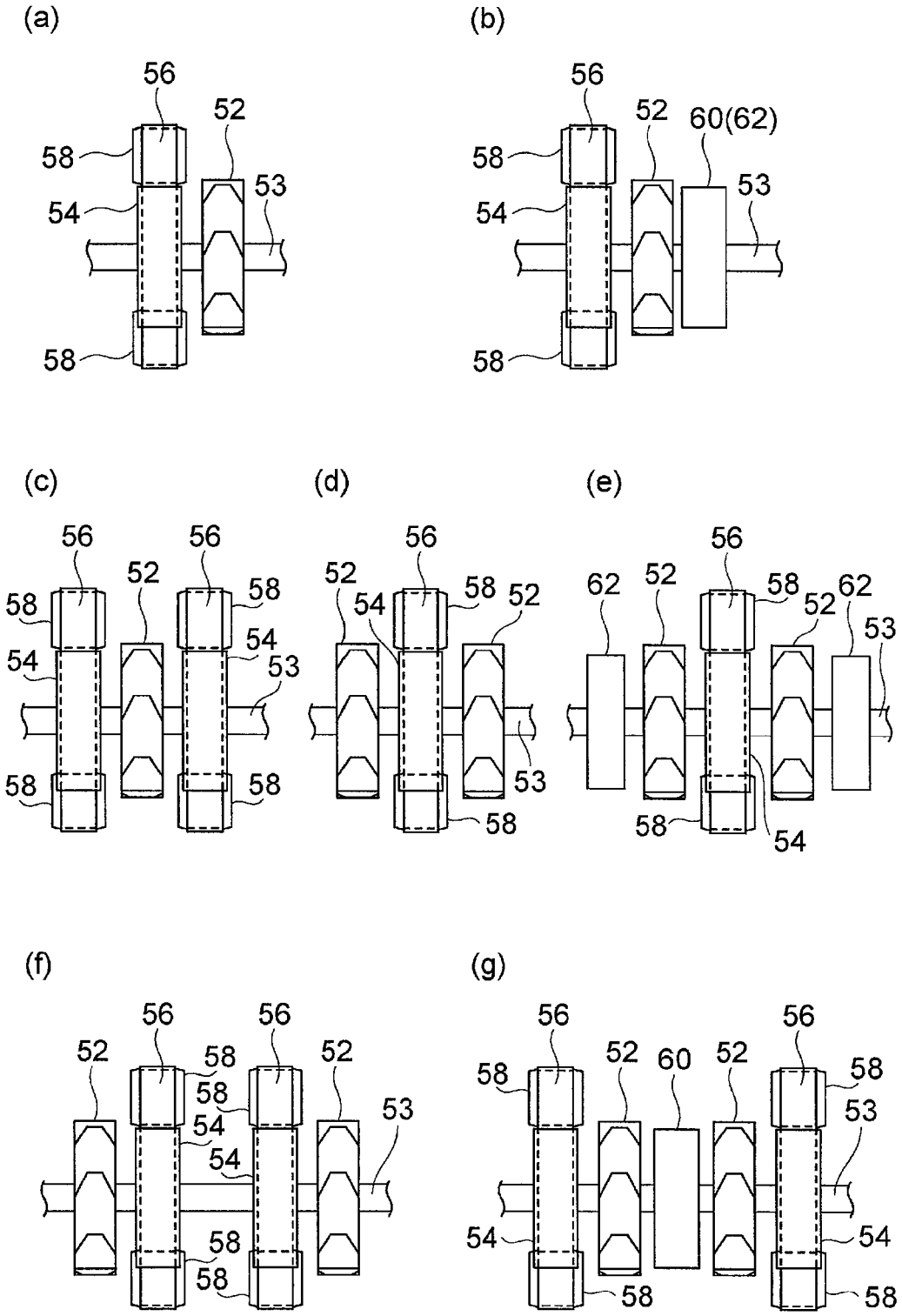
FIGS. 13(*a*) to 13(*g*) each illustrate still another configuration of a paper sheet stacking mechanism according to the embodiment of the present invention.
Figure 14:
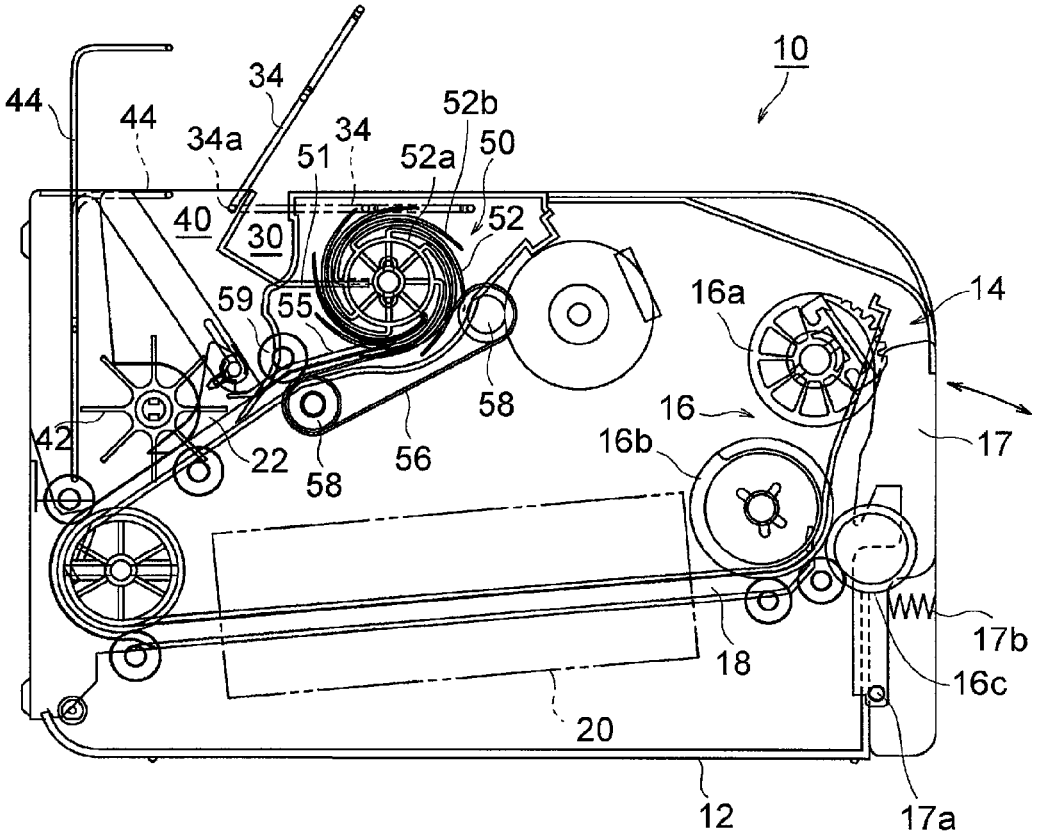
FIG. 14 is a schematic view illustrating the internal configuration of the paper sheet handling apparatus laid sideways according to the embodiment of the present invention.

Embodiments of the present invention will now be described with reference to the attached drawings. FIGS. 1 to 15 each illustrate a paper sheet handling apparatus according to an embodiment of the present invention. FIG. 1 is an external perspective view of the paper sheet handling apparatus according to an embodiment of the present invention. FIG. 2 is a front view of the paper sheet handling apparatus illustrated in FIG. 1. FIG. 3 is a top view of the paper sheet handling apparatus illustrated in FIG. 1, etc. FIG. 4 is a schematic view illustrating the internal configuration of the paper sheet handling apparatus illustrated in FIG. 1, etc. FIG. 5 illustrates the configuration of the paper sheet stacking mechanism viewed from the left side to the right side in FIG. 4. FIG. 6 is a side view of the paper sheet stacking mechanism along the arrow A-A of FIG. 5. FIG. 7(*i*) illustrates the configuration of the stacking wheel of the paper sheet stacking mechanism of the present invention, and FIGS. 7(*ii*), 7(*iii*), and 7(*iv*) each illustrate the configuration of the stacking wheel of a conventional paper sheet stacking mechanism. FIG. 8 is a table showing the properties of the stacking wheels illustrated in FIG. 7(*i*) to FIG. 7(*iv*). FIGS. 9 to 13 are each a side view of another configuration of a paper sheet stacking mechanism according to the embodiment of the present invention. FIG. 14 is a schematic side view of the paper sheet handling apparatus laid sideways according to an embodiment of the present invention.

Figure 15:
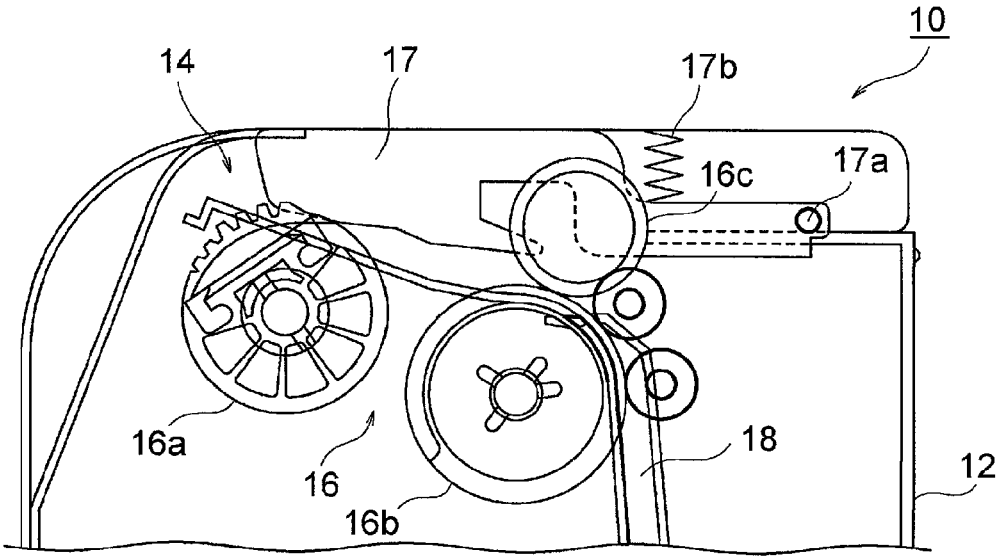
FIGS. 15(*a*) and 15(*b*) each illustrate the configuration of a hopper of the paper sheet handling apparatus according to the embodiment of the present invention in detail.
Figure 15:
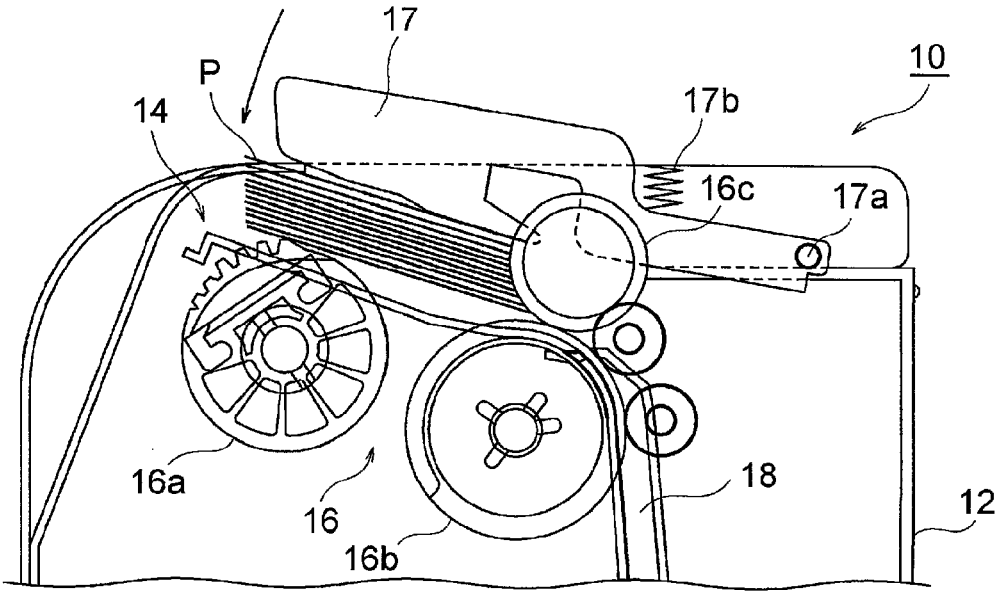

FIGS. 15(*a*) and 15(*b*) each illustrate the configuration of a hopper of the paper sheet handling apparatus according to the embodiment of the present invention in detail.

With reference to FIGS. 1 to 4, a paper sheet handling apparatus 10 according to an embodiment of the present invention includes a housing 12, a hopper 14 on which paper sheets to be counted is to be placed in a stacked manner, a feeding unit 16 for repeatedly feeding the lowermost one of a plurality of paper sheets in the hopper 14 into the housing 12, and a transport unit 18 accommodated in the housing 12 and for transporting each paper sheet fed from the feeding unit 16 into the housing 12. The transport unit 18 is provided with a recognition unit 20 for recognizing and counting the paper sheets fed from the feeding unit 16 into the housing 12.

As illustrated in FIG. 4, the feeding unit 16 includes kicker rollers 16*a* which comes into contact with the bottom surface of the lowermost paper sheet of the paper sheets stacked in the hopper 14, and feed rollers 16*b* disposed downstream of the kicker rollers 16*a* in the feeding direction of the paper sheets and for feeding the paper sheets kicked by the kicker rollers 16*a* into the housing 12. The feeding unit 16 also includes reverse rotation rollers (gate rollers) 16*c* facing the respective feed rollers 16*b*. Each feed roller 16*b* and the corresponding reverse rotation roller 16*c* form a gate therebetween. Each paper sheet kicked by the kicker rollers 16*a* passes through the gate to the transport unit 18 in the housing 12 one by one.

As illustrated in FIG. 4, etc., a pressing member 17 is provided adjacent to the hopper 14. The pressing member 17 is swingable about a shaft 17*a*, which is disposed at a base end of the pressing member 17, in the direction indicated by the arrow in FIG. 4. The pressing member 17 includes a spring 17*b* attached thereto. The repulsive force of the spring 17*b* from the compressed state urges the pressing member 17 toward the bottom surface of the hopper 14 so that the pressing member 17 is rotated counterclockwise about the shaft 17*a* in FIG. 4. The configuration of the pressing member 17 is described in detail below.

The transport unit 18 is composed of a combination of a transport belt with rollers. The transport belt is circulatable to transport the paper sheets gripped between the transport belt and the rollers along the transport path.

As described above, the transport unit 18 is provided with the recognition unit 20 for recognizing and counting the paper sheets fed from the feeding unit 16 into the housing 12. The recognition unit 20 is configured to recognize, for example, authenticity, fitness, and denomination of the paper sheets, is configured to detect an error in transporting the paper sheets, and is configured to count the paper sheets.

As shown in FIG. 4, the transport unit 18 has two diverted transport paths at a position downstream of the recognition unit 20. The downstream end of one of the transport paths is connected to a stacking unit 30, and the downstream end of the other transport path is connected to a reject unit 40. As illustrated in FIGS. 1, 2, and 4, the stacking unit 30 is disposed above the reject unit 40. In such a configuration, the paper sheets recognized and counted by the recognition unit 20 are selectively transported to the stacking unit 30 or the reject unit 40. An opening is provided in front of the stacking unit 30 (or on the left side of the housing 12 in FIG. 4). The operator can take out the paper sheets stacked in the stacking unit 30 through the opening. Another opening is provided in front of the reject unit 40. The operator can take out reject paper sheets stacked from the reject unit 40 through the opening.

As shown in FIGS. 1 and 4, a stopper 34 is disposed on the front side of the stacking unit 30. The stopper 34 is configured to prevent the paper sheets transported from the transport unit 18 to the stacking unit 30 from dropping out from the stacking unit 30 to the exterior of the housing 12. The stopper 34 is swingable about the shaft 34*a* in FIG. 4. To stack the paper sheets in the stacking unit 30, the stopper 34 is inclined so as to be disposed on the front side of the housing 12, as depicted with the solid lines in FIG. 4. To carry the paper sheet handling apparatus 10, the stopper 34 is retracted into the housing 12 of the paper sheet handling apparatus 10, as depicted with the chain double-dashed lines in FIG. 4, so as not to hinder the carry of the paper sheet handling apparatus 10.

Another stopper 44 is disposed on the front side of the reject unit 40. The stopper 44 is configured to prevent the paper sheets transported from the transport unit 18 to the reject unit 40 from dropping out from the stopper 44 to the exterior of the housing 12. The stopper 44 is movable in the right and left directions in FIG. 4. To stack the paper sheets in the reject unit 40, the stopper 44 is drawn so as to be disposed on the front side of the housing 12, as depicted with the solid lines in FIG. 4. To carry the paper sheet handling apparatus 10, the stopper 44 is retracted into the housing 12 of the paper sheet handling apparatus 10, as depicted with the chain double-dashed lines in FIG. 4, so as not to hinder the carry of the paper sheet handling apparatus 10.

As illustrated in FIG. 4, a diverter unit 22 including a diverter and a driver (not shown) for driving the diverter is disposed at the diverting position of the two diverted transport paths of the transport unit 18. The diverter unit 22 is configured to selectively transport the paper sheets fed upstream to the diverter unit 22 and to any one of the two transport paths. In addition, an elastic fin wheel 42 for pushing the paper sheets is disposed in the vicinity of the diverter unit 22. The elastic fin wheel 42 has multiple fins composed of flexible material, such as rubber. These fins radially and outwardly extend from the base of the elastic fin wheel 42. During the counterclockwise rotation of the elastic fin wheel 42 in FIG. 4, each fin of the elastic fin wheel 42 comes into contact with the surface of each paper sheet to send it to the reject unit 40 through the diverter unit 22. The reject paper sheets are thereby certainly transported to the reject unit 40. In this embodiment of the present invention, the elastic fin wheel 42 disposed in the vicinity of the reject unit 40 is coaxially aligned with a diverting roller (not shown) of the diverter unit 22. Such a configuration can reduce the dimensions of the paper sheet handling apparatus 10.

As illustrated in FIG. 4, stacking wheels 52 are disposed in an upper portion of the stacking unit 30. The configuration of the stacking wheels 52 will now be described in detail with reference to FIGS. 4 to 6. As shown in FIG. 5, right and left stacking wheels 52 are disposed in a symmetrical pair when the paper sheet handling apparatus 10 is viewed from the left side to the right side in FIG. 4. These stacking wheels 52 are rotatable counterclockwise about the shaft 53 which extends in a substantially horizontal direction perpendicular to the drawing plane of FIG. 4. As illustrated in FIG. 4, each stacking wheel 52 includes a base 52*a* rotatable about the shaft 53 and multiple (specifically, eight) vanes 52*b* outwardly extending from the outer periphery of the base 52*a* in a direction opposite to the rotational direction of the base 52*a*. These vanes 52*b* are disposed on the outer periphery of the base 52*a* at regular intervals.

During the operation of the paper sheet handling apparatus 10, the stacking wheels 52 are rotated counterclockwise about the shaft 53 driven by a drive motor (not shown) in FIG. 4. Paper sheets are fed one by one from the transport unit 18 to the stacking wheels 52. The paper sheet transported from the transport unit 18 enters the gap between two adjacent vanes 52*b* of each stacking wheel 52, and then the stacking wheels 52 transport the paper sheet to the stacking unit 30. Specifically, as illustrated in FIGS. 4 and 6, a guide member 51 is disposed in the vicinity of the stacking wheels 52. During the rotation of each stacking wheel 52, the front end edge of the paper sheet received in the gap between the vanes 52*b* of the stacking wheels 52 comes into contact with the guide member 51. The paper sheet is thereby released from the gap between the vanes 52*b* of the stacking wheel 52 and is stacked in the stacking unit 30 in an aligned state.

As shown in FIG. 5, a pair of right and left rollers 54 are respectively disposed outward from the right and left stacking wheels 52 so as to be coaxially aligned with the stacking wheels 52 in the axial direction of the shaft 53 (or the horizontal direction in FIG. 5). In addition, a first auxiliary roller 60 is disposed between the stacking wheels 52 in the axial direction of the shaft 53. Six second auxiliary rollers 62 in total are disposed outward from the right and left rollers 54 so as to be coaxially aligned with the stacking wheels 52 in the axial direction of the shaft 53. The rollers 54, the first auxiliary roller 60, and the second auxiliary rollers 62 are not fixed to the shaft 53 and are rotatable about the shaft 53. The configurations of the rollers 54, the first auxiliary roller 60, and the second auxiliary rollers 62 will now be described in detail.

As described above, the rollers 54 are disposed adjacent to the respective stacking wheels 52 so as to be coaxially aligned with the stacking wheels 52. Each roller 54 has a frictional member that is composed of rubber, for example, and that is disposed on the outer periphery of the roller 54. In addition, as illustrated in FIG. 6, each roller 54 has such a diameter that the outer periphery of the roller 54 is disposed outward from the outer periphery of the base 52*a* of the stacking wheel 52 and inward of a circular region defined by the tips of the vanes 52*b* of the stacking wheel 52 during the rotation of the stacking wheel 52, when viewed in the axial direction of the shaft 53 (i.e., viewed from the right or left side in FIG. 5). In other words, each roller 54 has a diameter greater than that of the base 52*a* of the stacking wheel 52 and smaller than that of the circular region defined by the tips of the vanes 52*b* of the stacking wheel 52 during the rotation of the stacking wheel 52.

As shown in FIGS. 5 and 6, transport belts 56 faces the rollers 54. Each transport belt 56 is tightly installed around pulleys 58 and is in partial contact with the outer periphery of the roller 54. With reference to FIG. 6, one pulley 58 among a plurality of the pulleys 58 is driven to rotate clockwise, so that the transport belt 56 circulates clockwise. The roller 54, which is not fixed to the shaft 53 and is rotatable about the shaft 53 as described above, is rotated counterclockwise together with the clockwise circulation of the transport belt 56 in FIG. 6. In this, the roller 54 rotates at a greater angular velocity than that of the stacking wheel 52. Specifically, the roller 54 rotates at two to ten times the angular velocity of the stacking wheel 52, for example. More specifically, the roller 54 rotates at 2.8 times the angular velocity of the stacking wheel 52, for example.

Another pulley 58 among a plurality of the pulleys 58, which is depicted at a lower portion of FIG. 6, contacts with a guide roller 59 with the transport belt 56 interposed between them. In such a configuration, a paper sheet transported from the transport unit 18 passes through a nip portion formed between the transport belt 56 and the guide roller 59, is transported in the upward direction in FIG. 6, and is transported into the gap between two adjacent vanes 52*b* of the stacking wheel 52 with the transport belt 56. In this embodiment, the transport belt 56 is located so as to limit the paper being transported until the gap between the vanes 52*b* of the stacking wheel 52 within a predetermined deviation amount. In addition, as illustrated in FIG. 6, a guide unit 55 faces the transport belt 56 at a certain distance. The guide unit 55 guides the paper sheet passing through the nip portion formed between the transport belt 56 and the guide roller 59, which are depicted at a lower portion of FIG. 6, to the gap between two adjacent vanes 52*b* of the stacking wheel 52. In such a configuration including the guide unit 55, the paper sheet passing through the nip portion formed between the transport belt 56 and the guide roller 59, which are depicted at a lower portion in FIG. 6, travels through the gap between the guide unit 55 and the transport belt 56, and is then transported to the gap between the roller 54 and the transport belt 56. The paper sheet is discharged from a discharge position between the roller 54 and the transport belt 56, and then enters the gap between two adjacent vanes 52*b* of the stacking wheel 52. In this embodiment, the transport belt 56 is located such that the discharge position (denoted by reference symbol P in FIG. 6), from which the paper sheet gripped between the roller 54 and the transport belt 56 is discharged, is disposed outward from the outer periphery of the base 52*a* of the stacking wheel 52 and inward of the circular region defined by the tips of the vanes 52*b* of the stacking wheel 52 during the rotation of the stacking wheel 52, when viewed in the axial direction of the shaft 53 of the stacking wheel 52 (or viewed from the right or left side in FIG. 5).

In this embodiment, these transport belts 56 configure a transport unit for transporting a paper sheet to the gap between two adjacent vanes 52*b* of each stacking wheel 52. It should be noted that the transport unit may be composed of any component other than the transport belts 56 facing the respective rollers 54, as described below.

As described above, each roller 54 has the frictional member that is composed of rubber, for example, and that is disposed on the outer periphery of the roller 54, in this embodiment. In addition, each roller 54 is rotatable about the shaft 53 at a greater angular velocity than that of the corresponding stacking wheel 52. In such a configuration, the front end edge of the paper sheet received in the gap between two adjacent vanes 52*b* of the stacking wheel 52 is thrust into the back of the gap (or toward the roots of the vanes 52*b*) by the friction generated between the paper sheet and the outer periphery of the roller 54. Even after the rear end edge of the paper sheet is discharged from the discharge position between the roller 54 and the transport belt 56, the drawing force of the roller 54 can hold the paper sheet in the gap between the vanes 52*b* of the stacking wheel 52 regardless of the resilience of the paper sheet, inhibiting the pushing-back of the paper sheet from the stacking wheel 52 before the contact of the front edge of the paper sheet with the guide member 51.

As described above, the first auxiliary roller 60 is disposed between the right and left stacking wheels 52 in the axial direction of the shaft 53 (refer to FIG. 5). The first auxiliary roller 60 is not fixed on the shaft 53 and is rotatable about the shaft 53. The first auxiliary roller 60 has a diameter greater than that of the base 52*a* of each stacking wheel 52. Such a first auxiliary roller 60 prevents excess thrust of the paper sheet into the back of the gap between the vanes 52*b* (or toward the roots of the vanes 52*b*) of the stacking wheel 52 by the friction generated between the paper sheet and the outer periphery of the roller 54. In other words, the outer periphery of the first auxiliary roller 60, which has a diameter greater than that of the base 52*a* of each stacking wheel 52, comes into contact with the front end edge of the paper sheet thrust into the back of the gap between the vanes 52*b* of the stacking wheel 52 to prevent the contact of the front end edge of the paper sheet with the outer periphery of the base 52*a* of the stacking wheel 52.

As illustrated in FIG. 5, six second auxiliary rollers 62 in total are disposed outward from the right and left rollers 54 so as to be coaxially aligned with the stacking wheels 52 in the axial direction of the shaft 53. These second auxiliary rollers 62 are not fixed to the shaft 53 and are rotatable about the shaft 53 respectively. Each second auxiliary roller 62 has a diameter not greater than that of each roller 54. Specifically, each second auxiliary roller 62 has a diameter 0.9 to 0.98 times the diameter of each roller 54, for example. These second auxiliary rollers 62, which are disposed outward from the pair of right and left rollers 54 in the axial direction of the shaft 53, guide the both right and left of short edge portions of the paper sheet received in the gap between the vanes 52*b* of the stacking wheel 52. This prevents the paper sheet received in the gap between the vanes 52*b* of the stacking wheel 52 from being folded at the right and left of short edge portions of the paper sheet and being trapped in a gap at the stacking unit 30 during the rotation of the stacking wheel 52.

In this embodiment, the first auxiliary roller 60 is composed of synthetic resin, for example. A frictional coefficient between the outer periphery of each roller 54 and a paper sheet to be stacked in the stacking unit 30 is greater than a frictional coefficient between the outer periphery of the first auxiliary roller 60 and the paper sheet to be stacked in the stacking unit 30. The second auxiliary rollers 62 are also composed of synthetic resin, for example. A frictional coefficient between the outer periphery of each roller 54 and a paper sheet to be stacked in the stacking unit 30 is greater than a frictional coefficient between the outer periphery of each second auxiliary roller 62 and the paper sheet to be stacked in the stacking unit 30. The outer peripheries of the rollers 54, the first auxiliary roller 60, and the second auxiliary rollers 62 have such frictional coefficients against a paper sheet to be stacked in the stacking unit 30, so that each roller 54 is rotatable about the shaft 53 at an angular velocity greater than the angular velocity of the corresponding stacking wheel 52. Furthermore, the outer periphery of each roller 54 has a greater frictional coefficient against the paper sheet, so that the paper sheet is thrust toward the back of the gap between the vanes 52*b* (or toward the roots of the vanes 52*b*) by the friction generated between the outer periphery of the roller 54 and the paper sheet. The paper sheet can be thereby held in the gap between the vanes 52*b* of the stacking wheel 52 regardless of the resilience of the paper sheet, inhibiting the pushing-back of the paper sheet from the stacking wheel 52 before the contact of the front end edge of the paper sheet with the guide member 51. The outer peripheries of the first auxiliary roller 60 and the second auxiliary rollers 62 which are configured to give no rotational driving force to the paper sheet received between the vanes 52*b* of the stacking wheel 52 have a smaller frictional coefficient respectively, as described above. This configuration can significantly reduce excess force of the first auxiliary roller 60 and the second auxiliary rollers 62 to thrust the paper sheet received between the vanes 52*b* of the stacking wheel 52 out of the stacking wheel 52.

In this embodiment, the stacking unit 30, a pair of the right and left stacking wheels 52, a pair of the right and left rollers 54, the first auxiliary roller 60, the second auxiliary rollers 62, the transport belts 56, and other components constitute a paper sheet stacking mechanism 50 for stacking paper sheets.

As shown in FIG. 1 etc., an operation/display unit 70 is disposed on the front side of the housing 12. The operation/display unit 70 includes a display unit 72, which is a liquid crystal display, for example, a plurality of and operation keys 74. The display unit 72 is configured to display the information on the processing status of paper sheets handled by the paper sheet handling apparatus 10, more specifically, the total number or the total monetary amount of the paper sheets counted by the recognition unit 20, for example. The operator can send various commands to a control unit (not shown) of the paper sheet handling apparatus 10 by pressing the operation keys 74.

In the paper sheet handling apparatus 10 according to the embodiment of the present invention, the kicker rollers 16*a*, the feed rollers 16*b*, and the reverse rotation rollers 16*c* of the feeding unit 16, the rollers and transport belt of the transport unit 18, the elastic fin wheel 42 for pushing paper sheets, the stacking wheels 52, the transport belts 56, and the other components are configured to be driven integrately by a single drive system. More specifically, rotational driving force of a single drive motor (not shown) accommodated in the housing 12 is transmitted to these components through a gear mechanism (not shown). Such a configuration can synchronize drives of the feeding unit 16, the transport unit 18, the stacking wheels 52, the transport belts 56, and the other components. In such a configuration, the transport timing of paper sheets can be controlled so that the front end edge of the paper sheet discharged from the discharge position between the roller 54 and the transport belt 56 can certainly enter the gap between the tip of one of the vanes 52*b* and the surface of an adjacent vane 52*b* of the stacking wheel 52. If the front end edge of a paper sheet discharged from the discharge position between the roller 54 and the transport belt 56 sits on the tip of one of the vanes 52*b* of the stacking wheel 52 or if the front end edge of a paper sheet discharged from the discharge position between the roller 54 and the transport belt 56 is excessively thrust into the back of the gap between the vanes 52*b* (or toward the roots of the vanes 52*b*), the stacking wheel 52 may fail to securely stack the paper sheet in the stacking unit 30. To avoid the risk, an appropriate transport timing of paper sheets is determined under the synchronization among the drives of the feeding unit 16, the transport unit 18, the stacking wheels 52, the transport belts 56, and other components as described in this embodiment. As a result, the front end edge of the paper sheet discharged from the discharge position between the roller 54 and the transport belt 56 can securely enter the gap between the tip of one of the vanes 52*b* and the surface of an adjacent vane 52*b* of the stacking wheel 52.

As described above, the pressing member 17 is provided at the hopper 14 and is swingable about the shaft 17*a* disposed at a base end of the pressing member 17 in the direction indicated by the arrow in FIG. 4. The pressing member 17 includes a spring 17*b* attached thereto. The repulsive force of the spring 17*b* from the compressed state urges the pressing member 17 toward the bottom surface of the hopper 14, so that the pressing member 17 is rotated counterclockwise about the shaft 17*a* in FIG. 4. More specifically, one end (the lower end in FIG. 4) of the spring 17*b* is attached to the top of the pressing member 17, and the other end (upper end in FIG. 4) of the spring 17*b* is fixed to the inner surface of the housing 12 of the paper sheet handling apparatus 10. When no paper sheet is placed in the hopper 14, the pressing member 17 is located at the position illustrated in FIG. 15(*a*). In this state, a narrow gap is formed between the lower portion of the pressing member 17 and the bottom surface of the hopper 14. When a small number of paper sheets are placed in the hopper 14, the narrow gap prevents the paper sheets from being caught between the lower portion of the pressing member 17 and the bottom surface of the hopper 14. Before putting a large number of (for example, 50) paper sheets (denoted by reference symbol P in FIG. 15(*b*)) in the hopper 14, as illustrated in FIG. 15(*b*), the operator manually rotates the pressing member 17 about the shaft 17*a* in the clockwise direction opposite to the direction of the pressing force of the spring 17*b* in FIG. 15, and places a batch of paper sheets in the hopper 14. Then the pressing member 17 holds down the paper sheets.

The pressing member 17 provided at the hopper 14 can hold down a large number of paper sheets in the hopper 14, as described above. This can stabilize the feeding operation of the feeding unit 16. In addition, the operator only has to manually rotate the pressing member 17 about the shaft 17*a* in the clockwise direction in FIG. 15 to place the paper sheets, so that the pressing member 17 holds down the paper sheets in the hopper 14. The operator therefore can readily handle the paper sheet handling apparatus 10. When the paper sheet handling apparatus 10 is laid sideways as illustrated in FIG. 14, the hopper 14 and the pressing member 17 can hold the paper sheets therebetween such that the paper sheets are vertically orientated in the hopper 14, as described below.

The operation of the paper sheet handling apparatus 10 having such a configuration will now be described.

At the start of the operation of the paper sheet handling apparatus 10, the operator puts a batch of paper sheets to be handled with the paper sheet handling apparatus 10 in the hopper 14. After putting the batch of the paper sheets, the operator presses a start key, for example, which is one of the operation keys 74 of the operation/display unit 70, to send the command to start the counting of the paper sheets to the control unit in the paper sheet handling apparatus 10. In response to the command, the feeding unit 16 feeds the lowermost paper sheet of the batch in the hopper 14 one by one to the transport unit 18 in the housing 12. Each paper sheet fed from the feeding unit 16 is transported by the transport unit 18 in the housing 12.

The paper sheets transported by the transport unit 18 are recognized and counted by the recognition unit 20. A paper sheet recognized as a fit note by the recognition unit 20 is further transported by the transport unit 18 and is then transported to the stacking unit 30 through the diverter unit 22. In this case, the paper sheet transported from the transport unit 18 to the paper sheet stacking mechanism 50 passes through the nip portion formed between the transport belt 56 and the guide roller 59, is transported in the upward direction in FIG. 6. The paper sheet then passes through the gap between the guide unit 55 and the transport belt 56 and is transported to the gap between the roller 54 and the transport belt 56. The paper sheet is discharged from a discharge position (denoted by reference symbol P in FIG. 6) between the roller 54 and the transport belt 56, and then enters the gap between two adjacent vanes 52*b* of the stacking wheel 52. The stacking wheel 52 carrying the paper sheet in the gap between the vanes 52*b* then rotates, so that the front end edge of the paper sheet comes into contact with the guide member 51. Upon the contact, the paper sheet is released from the gap between the vanes 52*b* of the stacking wheel 52 and is stacked in the stacking unit 30. This operation can stack the paper sheets in the stacking unit 30 in an aligned state. The operator can readily take out the paper sheet from the stacking unit 30 through the opening in front of the stacking unit 30.

A paper sheet recognized as a reject note by the recognition unit 20 is further transported by the transport unit 18 and is then transported to a reject unit 40 through the diverter unit 22. As an opening in front of the reject unit 40 is opened at all times, the operator can readily take out the paper sheets from the reject unit 40 through the opening.

After all paper sheets in the hopper 14 are fed in the housing 12 and are transported to the stacking unit 30 or the reject unit 40, the handling of the paper sheets with the paper sheet handling apparatus 10 is completed.

In the paper sheet stacking mechanism 50 having such a configuration and the paper sheet handling apparatus 10 including the paper sheet stacking mechanism 50 according to the embodiment of the present invention, the rollers 54 are disposed axially outward from the respective stacking wheels 52 so as to be coaxially aligned with the stacking wheels 52. The rollers 54 are rotatable about the shaft 53 at a greater angular velocity than those of the stacking wheels 52. In such a configuration, the front end edge of the paper sheet received in the gap between two adjacent vanes 52*b* of the stacking wheel 52 is thrust into the back of the gap (or toward the roots of the vanes 52*b*) by the friction generated between the paper sheet and the outer periphery of the roller 54. Even after the rear end edge of the paper sheet is discharged from the discharge position between the roller 54 and the transport belt 56, the drawing force of the roller 54 can hold the paper sheet in the gap between the vanes 52*b* of the stacking wheel 52 regardless of the resilience of the paper sheet, inhibiting the pushing-back of the paper sheet from the stacking wheel 52 before the contact of the front end edge of the paper sheet with the guide member 51. In addition, the transport belts 56, which function as a transport unit for transporting a paper sheet to the gap between two adjacent vanes 52*b* of the stacking wheel 52, face the respective rollers 54, and are each located such that the discharge position, from which the paper sheet gripped between the roller 54 and the transport belt 56 is discharged, is disposed outward from the outer periphery of the base 52*a* of the corresponding stacking wheel 52 and inward of the circular region defined by the tips of the vanes 52*b* of the stacking wheel 52, when viewed in the axial direction of the shaft 53 of the stacking wheel 52, as described above. In such a configuration, each stacking wheel 52 even can securely receive a limp paper sheet discharged from the discharge position between the roller 54 and the transport belt 56 in the gap between the vanes 52*b*.

When the rollers 54 are disposed adjacent to the respective stacking wheels 52 so as to be coaxially aligned with the stacking wheels 52 and each roller 54 thrusts the paper sheet received in the gap between two adjacent vanes 52*b* of the stacking wheel 52 into the back of the gap (toward the roots of the vanes 52*b*), each stacking wheel 52 having such a configuration can be compact, compared with the stacking wheel of a conventional paper sheet stacking mechanism. A conventional compact paper sheet stacking mechanism including a compact stacking wheel may cause the pushing-back of the paper sheet from the stacking wheel before the front end edge of the paper sheet reaches a guide member, because the paper sheet received in the gap between two adjacent vanes of the compact stacking wheel has higher resilience. In contrast, the compact paper sheet stacking mechanism including the compact stacking wheels 52 according to the embodiment of the present invention is free from such a trouble because each roller 54 forcedly thrusts the paper sheet received in the gap between two adjacent vanes 52*b* of the stacking wheel 52 into the back of the gap (toward the roots of the vanes 52*b*). These compact stacking wheels will be described with reference to FIGS. 7 and 8.

FIG. 7(*i*) is a side view of the compact stacking wheel 52 used in the paper sheet stacking mechanism 50 of the present invention. FIG. 7(*ii*) is a side view illustrating the configuration of a conventional stacking wheel 52*p*, FIG. 7(*iii*) is a side view illustrating the configuration of a conventional stacking wheel 52*q*, and FIG. 7(*iv*) is a side view illustrating the configuration of a conventional stacking wheel 52*r*. FIG. 8 is a table showing the specifications of the stacking wheels 52, 52*p*, 52*q*, and 52*r* that are illustrated in FIGS. 7(*i*) to 7(*iv*), respectively. More specifically, the specification of the stacking wheel 52 illustrated in FIG. 7(*i*) are shown in the columns of "(i) Inventive" in FIG. 8, the specification of the conventional stacking wheels 52*p*, 52*q*, and 52*r*, which are respectively illustrated in FIGS. 7(*ii*), 7(*iii*), and 7(*iv*), are shown in the columns of "(ii) Comparative Example 1", "(iii) Comparative Example 2", and "(iv) Comparative Example 3", respectively, in FIG. 8.

As shown in FIG. 8, the outer diameters of the conventional stacking wheels 52*p*, 52*q*, and 52*r*, which correspond to the diameters of the circular regions defined by the tips of the vanes of these stacking wheels, are 70 mm or 100 mm. These conventional stacking wheels 52*p*, 52*q*, and 52*r* each have 12 or 16 vanes. In contrast, the stacking wheel 52 of the present invention has an outer diameter of 45 mm, which is smaller than that of the conventional stacking wheel 52*p*, 52*q*, or 52*r*. In addition, the number of the vanes of the stacking wheel 52 of the present invention is eight, which is less than the number of the vanes of each conventional stacking wheel. Such a compact stacking wheel 52 having a reduced number of vanes, i.e. even to eight, can securely receive a paper sheet in the gap between two adjacent vanes 52*b* and stack the paper sheet in the stacking unit 30 in an aligned state.

As to the conventional stacking wheel 52*p*, 52*q*, or 52*r*, a minimum distance (denoted by reference symbol "a" in FIG. 7) is, 7.84 mm, 3.01 mm, or 4.39 mm (refer to FIG. 8), for example, between the tip of each vane and the surface of an adjacent vane. In contrast, as to the present invention, a minimum distance is within a range of 1.5 mm to 3.0 mm, specifically, 2.70 mm (refer to FIG. 8), for example, between the tip of each vane 52*b* and the surface of an adjacent vane 52*b* of the stacking wheel 52. More specifically, upon making vanes 52*b* compact according to the present invention, as a minimum distance decreases between the tip of each vane 52*b* and the surface of an adjacent vane 52*b*, the outer diameter of the stacking wheel 52 decreases. In a compact stacking wheel 52, a minimum distance greater than 3.0 mm between the tip of each vane 52*b* and the surface of an adjacent vane 52*b* forms an excessively wide gap, so that the stacking wheel 52 has an excessively large outer diameter. On the other hand, a minimum distance less than 1.5 mm between the tip of each vane 52*b* and the surface of an adjacent vane 52*b* forms an excessively narrower gap, so that the stacking wheel 52 may fail to securely receive a paper sheet in the narrower gap.

Each vane of the conventional stacking wheel 52*p*, 52*q*, or 52*r* has such a length that forms the angle (denoted by reference symbol b in FIG. 7) of 112.50°, 144.84°, or 132.00° (refer to FIG. 8), for example, between the straight line from the tip of the vane to the shaft of the stacking wheel and the straight line from the root of the vane attached to the base to the shaft of the stacking wheel. In contrast, each vane 52*b* of the stacking wheels 52 of the present invention has such a length that forms the angle of within a range of 150° to 180°, specifically, 155.68° (refer to FIG. 8), for example, between the straight line from the tip of the vane 52*b* to the center of the shaft 53 of the stacking wheel 52 and the straight line from the root of the vane 52*b* attached to the base 52*a* to the center of the shaft 53 of the stacking wheel 52. In more detailed description, each vane 52*b* of the compact stacking wheel 52 should have a long length relative to the dimensions of the base 52*a*. Under such requirements, when the angle is less than 150° between the straight line from the tip of the vane 52*b* to the center of the shaft 53 of the stacking wheel 52 and the straight line from the root of the vane 52*b* attached to the base 52*a* to the center of the shaft 53 of the stacking wheel 52, the vane 52*b* of the compact stacking wheel 52 has insufficient length. Therefore, a stacking wheel 52 having such vanes 52*b* may fail to securely receive a paper sheet in the gap between two adjacent vanes 52*b* of the stacking wheel 52. On the other hand, when the angle is greater than 180° between the straight line from the tip of each vane 52*b* to the center of the shaft 53 and the straight line from the root of the vane 52*b* attached to the base 52*a* to the center of the shaft 53 of the stacking wheel 52, the vane 52*b* has excessive length relative to the size of the paper sheet. A stacking wheel 52 having such vanes 52*b* has an excessively large outer diameter.

As described above, each vane 52*b* of the compact stacking wheel 52 of the present invention should preferably have such a length that a minimum distance is within a range of 1.5 mm to 3.0 mm between the tip of the vane 52*b* and the surface of an adjacent vane 52*b*. And also it is preferable that the angle is within a range of 150° to 180° defined between the straight line from the tip of the vane 52*b* to the center of the shaft 53 of the stacking wheel 52 and the straight line from the root of the vane 52*b* attached to the base 52*a* to the center of the shaft 53 of the stacking wheel 52.

In the conventional paper sheet handling apparatus including a relatively large stacking wheel, the stacking unit is disposed at a lower portion of the paper sheet handling apparatus, and the reject unit is disposed above the stacking unit. In contrast, the paper sheet handling apparatus 10 of the present invention including the compact stacking wheels 52 illustrated in FIG. 7(*i*) can have an internal layout configuration in which the reject unit 40 is disposed at a lower portion of the paper sheet handling apparatus 10 and the stacking unit 30 is disposed above the reject unit 40, as illustrated in FIG. 4. Such an internal layout configuration of the paper sheet handling apparatus 10 can significantly reduce the depth of the housing 12, and thus can reduce the entire dimensions of the apparatus, compared with the conventional paper sheet handling apparatus. In addition, in the paper sheet handling apparatus 10 of the embodiment of the present invention, the elastic fin wheel 42 disposed in the vicinity of the reject unit 40 are coaxially arranged with the diverting rollers (not shown) of the diverter unit 22, as described above. Such a configuration can further reduce the dimensions of the paper sheet handling apparatus 10.

The paper sheet handling apparatus 10 of the present invention, which has the internal layout configuration described above, can be laid sideways as illustrated in FIG. 14. In this case, the operator puts a batch of paper sheets to be handled with the paper sheet handling apparatus 10 in the hopper 14 such that the paper sheets are vertically orientated in the hopper 14, and then presses the start key, for example, which is one of the operation keys 74 of the operation/display unit 70 to send the command to start the counting of the paper sheets to the control unit in the paper sheet handling apparatus 10. In response to the command, the feeding unit 16 feeds the vertically oriented paper sheets in the hopper 14 to the transport unit 18 in the housing 12 one by one. As described above, the pressing member 17 is provided adjacent to the hopper 14, and the hopper 14 and the pressing member 17 can hold the paper sheets therebetween such that the paper sheets are vertically orientated in the hopper 14. To handle the paper sheets with the paper sheet handling apparatus 10 laid sideways, the operator puts a batch of vertically oriented paper sheets in the hopper 14. Each paper sheet fed from the feeding unit 16 to the transport unit 18 in the housing 12 is transported by the transport unit 18 to the recognition unit 20, and is recognized and counted by the recognition unit 20. A paper sheet recognized as a normal note by the recognition unit 20 is further transported by the transport unit 18 and is then transported to the stacking unit 30 through the diverter unit 22. The operator can readily take out the paper sheets from the stacking unit 30 through the opening above the stacking unit 30 of the paper sheet handling apparatus 10 laid sideways. A paper sheet recognized as a reject note by the recognition unit 20 is further transported by the transport unit 18 and is then transported to the reject unit 40 through the diverter unit 22. The operator can take out the paper sheet from the reject unit 40 through the opening above the reject unit 40 of the paper sheet handling apparatus 10 laid sideways.

As described above, even when the paper sheet handling apparatus 10 is laid sideways, the vertically oriented paper sheets placed in the hopper 14 are fed into the housing 12, are recognized and counted by the recognition unit 20, and are then stacked in the stacking unit 30 or the reject unit 40.

It should be noted that the paper sheet stacking mechanism 50 of the embodiment and the paper sheet handling apparatus 10 including the paper sheet stacking mechanism 50 are not limited to the above-configuration and may have any other configuration and may include various alterations.

Figure 9:
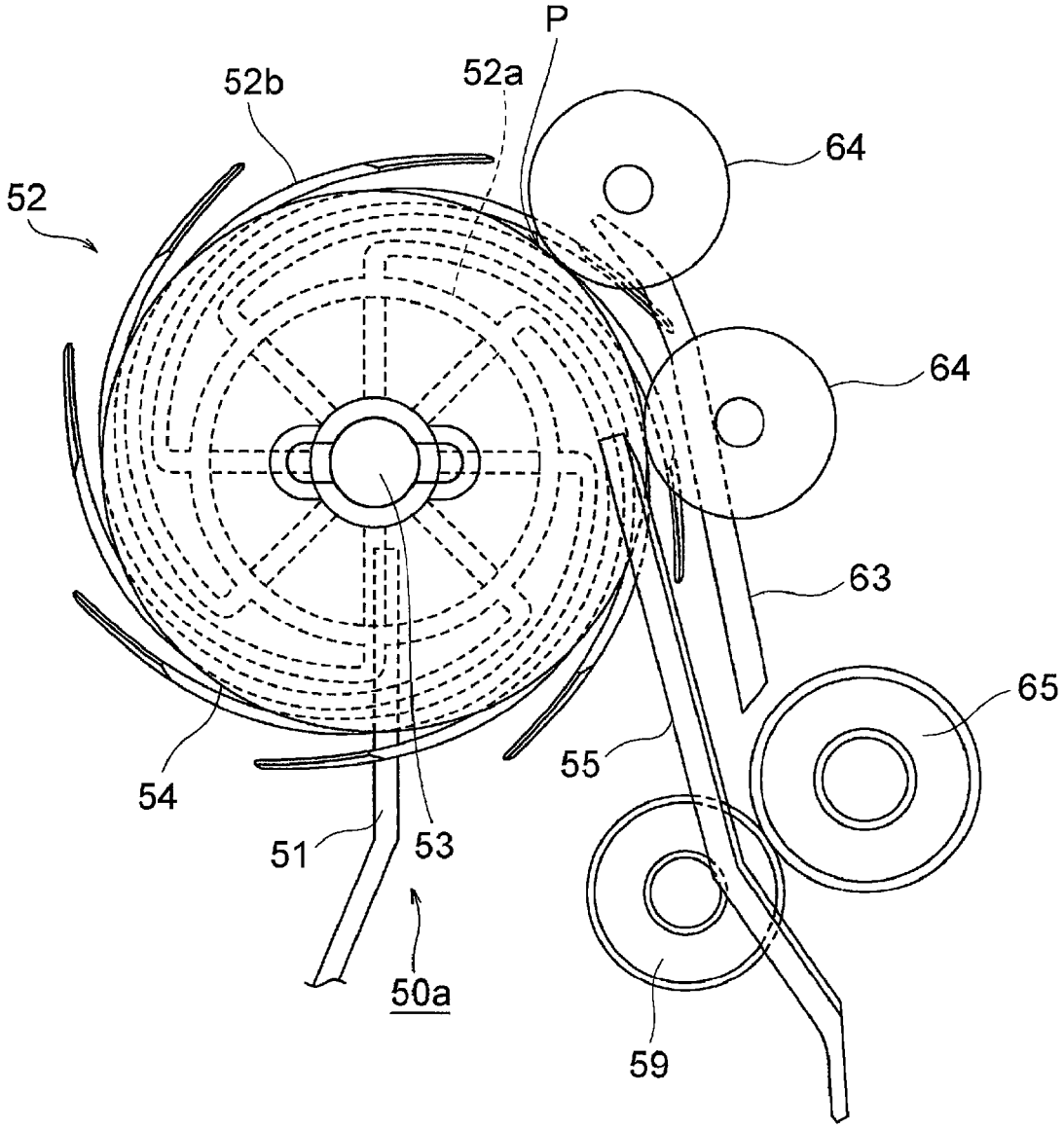
FIG. 9 is a side view of another configuration of a paper sheet stacking mechanism according to the embodiment of the present invention.

For example, the transport unit of the paper sheet stacking mechanism for transporting a paper sheet to the gap between two adjacent vanes 52*b* of the stacking wheel 52 may be composed of any component other than the transport belts 56 facing the respective rollers 54. The transport unit for transporting a paper sheet to the gap between two adjacent vanes 52*b* of the stacking wheel 52 may be composed of a counter roller 64 in partial contact with the outer periphery of the corresponding roller 54, as illustrated in FIG. 9. A plurality of counter rollers 64 that are each in partial contact with the outer periphery of the roller 54 can be used. The counter roller 64 has a frictional member that is composed of rubber, etc. for example, and that is disposed on the outer periphery of the counter roller 64. The configuration of a paper sheet stacking mechanism 50*a* according to a modification illustrated in FIG. 9 will now be described in detail. The common component between the paper sheet stacking mechanism 50*a* according to the modification illustrated in FIG. 9 and the paper sheet stacking mechanism 50 illustrated in FIG. 6 and so on is denoted by the same reference numerals. Redundant descriptions will not be referred.

The paper sheet stacking mechanism 50*a* according to the modification illustrated in FIG. 9 includes a plurality of counter rollers 64 that are in contact with a roller 54 and that are configured to function as a transport unit for transporting a paper sheet to the gap between two adjacent vanes 52*b* of a stacking wheel 52, and a guide unit 63 that is configured to limit the paper sheet being transported until the gap between the vanes 52*b* of the stacking wheel 52 with the counter rollers 64 within a predetermined deviation amount. When the counter rollers 64 are driven to clockwise rotate in FIG. 9, the roller 54 is rotated counterclockwise together with the clockwise rotation of the counter rollers 64 in FIG. 9. The roller 54 is rotatable at two to ten times the angular velocity of the stacking wheel 52, for example. Specifically, the roller 54 is rotatable at 2.8 times faster than the angular velocity of the stacking wheel 52, for example.

The paper sheet stacking mechanism 50*a* according to the modification further includes paired guide rollers 59 and 65 disposed at an inlet of a paper sheet (i.e., the position through which the paper sheet transported from a transport unit 18 enters). In such a configuration, the paper sheet transported from the transport unit 18 passes through a nip portion formed between the guide rollers 59 and 65, is transported in an upward direction in FIG. 9, and enters the gap between two adjacent vanes 52*b* of the stacking wheel 52 by the counter rollers 64. In this modification, the guide unit 63 is provided to limit the paper sheet being transported until the gap between the vanes 52*b* of the stacking wheel 52 with the counter rollers 64 within a predetermined deviation amount. In this manner, the paper sheet transported from the transport unit 18 and passing through the nip portion formed between the guide rollers 59 and 65 travels through the gap between a guide unit 55 and the guide unit 63, and is then transported to the gap between the roller 54 and the counter rollers 64. The paper sheet is discharged from a discharge position between the most downstream one of the counter rollers 64 and the roller 54 and then enters the gap between two adjacent vanes 52*b* of the stacking wheel 52. In the paper sheet stacking mechanism 50*a* according to the modification illustrated in FIG. 9, the counter rollers 64 are located such that the discharge position (denoted by reference symbol P in FIG. 9), from which the paper sheet gripped between the most downstream one of the counter rollers 64 and the roller 54 is discharged, is disposed outward from the outer periphery of the base 52*a* of the stacking wheel 52 and inward of the circular region defined by the tips of the vanes 52*b* of the stacking wheel 52 during the rotation of the stacking wheel 52, when viewed in the axial direction of a shaft 53 of the stacking wheel 52.

Also in the paper sheet stacking mechanism 50*a* according to the modification illustrated in FIG. 9, the roller 54 has a frictional member that is composed of rubber, etc. for example, and that is disposed on the outer periphery of the roller 54. In addition, the roller 54 is rotatable about the shaft 53 at a greater angular velocity than that of the stacking wheel 52. In such a configuration, the front end edge of the paper sheet received in the gap between two adjacent vanes 52*b* of the stacking wheel 52 is thrust into the back of the gap (toward the roots of the vanes 52*b*) by the friction generated between the paper sheet and the outer periphery of the roller 54. Even after the rear end edge of the paper sheet is discharged from the discharge position between the most downstream one of the counter rollers 64 and the roller 54, the drawing force of the roller 54 can hold the paper sheet in the gap between the vanes 52*b* of the stacking wheel 52 regardless of the resilience of the paper sheet, inhibiting the pushing-back of the paper sheet from the stacking wheel 52 before the contact of the front end edge of the paper sheet with a guide member 51.

Figure 10:
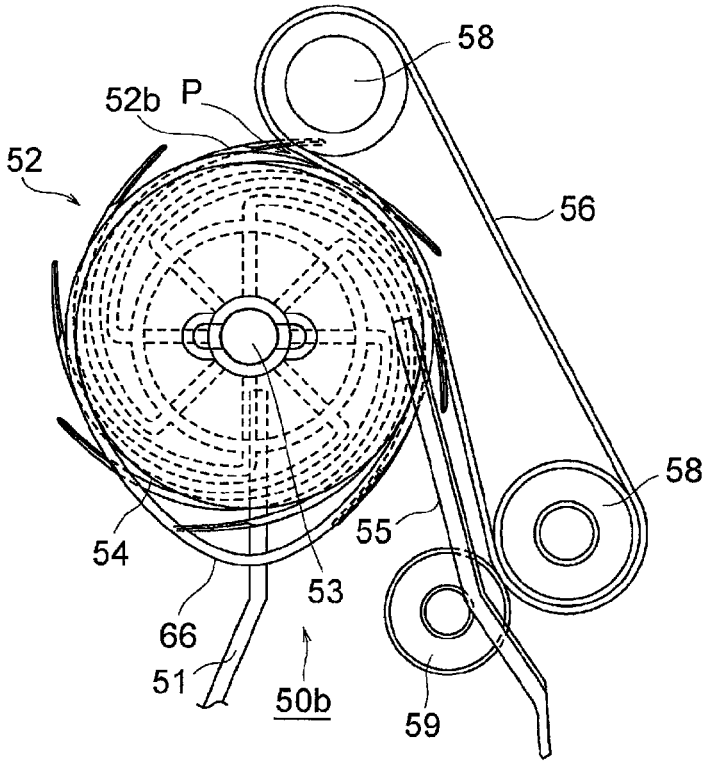
FIG. 10 is a side view of still another configuration of a paper sheet stacking mechanism according to the embodiment of the present invention.

A paper sheet stacking mechanism 50*b* according to another modification illustrated in FIG. 10 may include an auxiliary belt 66 wound around a roller 54. In the paper sheet stacking mechanism 50*b*, a transport belt 56, which partially contacts with the outer periphery of the roller 54 with the auxiliary belt 66 interposed between them which is in partial contact with, is configured to function as a transport unit for transporting a paper sheet to the gap between two adjacent vanes 52*b* of a stacking wheel 52. The configuration of the paper sheet stacking mechanism 50*b* according to the modification illustrated in FIG. 10 will now be described in detail. The common component between the paper sheet stacking mechanism 50*b* according to the modification illustrated in FIG. 10 and the paper sheet stacking mechanism 50 illustrated in FIG. 6 is denoted by the same reference numerals. Redundant descriptions will not be referred.

As shown in FIG. 10, the auxiliary belt 66 wound around the roller 54 is an endless belt. Part of the auxiliary belt 66 is in contact with the outer periphery of the roller 54 and the other part of the auxiliary belt 66 sags from the outer periphery of the roller 54. The transport belt 56 partially contacts with the outer periphery of the roller 54 with the auxiliary belt 66 interposed between them. The auxiliary belt 66 is circulated counterclockwise together with the clockwise circulation of the transport belt 56 in FIG. 10. The roller 54 is rotated counterclockwise together with the auxiliary belt 66 in FIG. 10. The roller 54 is rotatable at a greater angular velocity than that of the stacking wheel 52. Specifically, the roller 54 is rotatable at two to ten times the angular velocity of the stacking wheel 52, for example. More specifically, the roller 54 is rotatable at 2.8 times the angular velocity of the stacking wheel 52, for example.

In the paper sheet stacking mechanism 50*b* according to the modification illustrated in FIG. 10, the paper sheet passing through the nip portion formed between the transport belt 56 and a guide roller 59 travels through the gap between a guide unit 55 and the transport belt 56, and is then transported to the gap between the auxiliary belt 66 and the transport belt 56. The paper sheet is discharged from a discharge position between the auxiliary belt 66 and the transport belt 56 and then enters the gap between two adjacent vanes 52*b* of the stacking wheel 52. In this modification, the transport belt 56 and the auxiliary belt 66 are located such that the discharge position (denoted by reference symbol P in FIG. 10), from which the paper sheet gripped between the auxiliary belt 66 and the transport belt 56 is discharged, is disposed outward from the outer periphery of the base 52*a* of the stacking wheel 52 and inward of the circular region defined by the tips of the vanes 52*b* of the stacking wheel 52 during the rotation of the stacking wheel 52, when viewed from the axial direction of a shaft 53 of the stacking wheel 52.

Also in the paper sheet stacking mechanism 50*b* according to the modification illustrated in FIG. 10, the roller 54 is rotatable about the shaft 53 at a greater angular velocity than that of the stacking wheel 52. In such a configuration, the front end edge of the paper sheet received in the gap between two adjacent vanes 52*b* of the stacking wheel 52 is thrust into the back of the gap (toward the roots of the vanes 52*b*) by the friction generated between the paper sheet and the outer periphery of the auxiliary belt 66 wound around the roller 54. Even after rear end edge of the paper sheet is discharged from the discharge position between the auxiliary belt 66 and the transport belt 56, the drawing force of the auxiliary belt 66 can hold the paper sheet in the gap between the vanes 52*b* of the stacking wheel 52 regardless of the resilience of the paper sheet, inhibiting the pushing-back of the paper sheet from the stacking wheel 52 before the contact of the front end edge of the paper sheet with a guide member 51.

Figure 11:
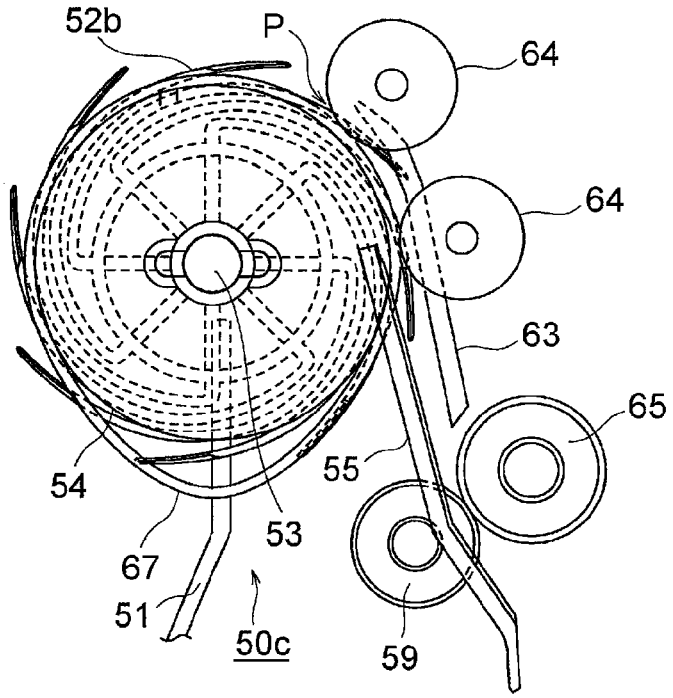
FIG. 11 is a side view of still another configuration of a paper sheet stacking mechanism according to the embodiment of the present invention.

A paper sheet stacking mechanism 50*c* according to another modification illustrated in FIG. 11 includes an auxiliary belt 67 wound around a roller 54. In the paper sheet stacking mechanism 50*c*, counter rollers 64, which partially contacts with the outer periphery of the roller 54 with the auxiliary belt 67 interposed between them, are configured to function as a transport unit for transporting a paper sheet to the gap between two adjacent vanes 52*b* of the stacking wheel 52. The configuration of the paper sheet stacking mechanism 50*c* according to the modification illustrated in FIG. 11 will now be described in detail. The common component between the paper sheet stacking mechanism 50*c* according to the modification illustrated in FIG. 11 and the paper sheet stacking mechanism 50*a* illustrated in FIG. 9 is denoted by the same reference numerals. Redundant descriptions will not be referred.

As shown in FIG. 11, the auxiliary belt 67 wound around the roller 54 is an endless belt. Part of the auxiliary belt 67 is in contact with the outer periphery of the roller 54 and the other part of the auxiliary belt 67 sags from the outer periphery of the roller 54. The counter rollers 64 are in partial contact with the auxiliary belt 67 which is in partial contact with the outer periphery of the roller 54. The auxiliary belt 67 is rotated counterclockwise together with the clockwise rotation of the counter rollers 64 in FIG. 11. The roller 54 is rotated counterclockwise together with the auxiliary belt 67 in FIG. 11. The roller 54 is rotatable at a greater angular velocity than that of the stacking wheel 52. Specifically, the roller 54 is rotatable at two to ten times the angular velocity of the stacking wheel 52, for example. More specifically, the roller 54 is rotatable at 2.8 times the angular velocity of the stacking wheel 52, for example.

In the paper sheet stacking mechanism 50*c* according to the modification illustrated in FIG. 11, the paper sheet passing through the nip portion formed between a pair of guide rollers 59 and 65, which are depicted at a lower portion in FIG. 11, travels through the gap between guide units 55 and 63, and is then transported to the gap between the auxiliary belt 67 and the counter rollers 64. The paper sheet is discharged from a discharge position between the most downstream one of the counter rollers 64 and the auxiliary belt 67 and then enters the gap between two adjacent vanes 52*b* of the stacking wheel 52. In this modification, the counter rollers 64 and the auxiliary belt 67 are located such that the discharge position (denoted by reference symbol P in FIG. 11), from which the paper sheet gripped between the most downstream one of the counter rollers 64 and the auxiliary belt 67 is discharged, is disposed outward from the outer periphery of the base 52*a* of the stacking wheel 52 and inward of the circular region defined by the tips of the vanes 52*b* of the stacking wheel 52 during the rotation of the stacking wheel 52, when viewed from the axial direction of a shaft 53 of the stacking wheel 52.

Also in the paper sheet stacking mechanism 50*c* according to another modification illustrated in FIG. 11, the roller 54 is rotatable about the shaft 53 at a greater angular velocity than that of the stacking wheel 52. In such a configuration, the front end edge of the paper sheet received in the gap between two adjacent vanes 52*b* of stacking wheel 52 is thrust into the back of the gap (toward the roots of the vanes 52*b*) by the friction generated between the paper sheet and the outer periphery of the auxiliary belt 67 wound around the roller 54. Even after the rear end edge of the paper sheet is discharged from the discharge position between the most downstream one of the counter rollers 64 and the auxiliary belt 67, the drawing force of the auxiliary belt 67 can hold the paper sheet in the gap between the vanes 52*b* of the stacking wheel 52 regardless of the resilience of the paper sheet, inhibiting the pushing-back of the paper sheet from the stacking wheel 52 before the contact of the front end edge of the paper sheet with a guide member 51.

In the above description, the auxiliary belt 66 of the paper sheet stacking mechanism 50*b* according to the modification illustrated in FIG. 10 and the auxiliary belt 67 of the paper sheet stacking mechanism 50*c* according to the modification illustrated in FIG. 11 are endless belts wound around the respective rollers 54. Parts of the auxiliary belts 66 and 67 are in contact with the outer periphery of the roller 54 and the other parts of the auxiliary belts 66 and 67 sag from the outer periphery of the roller 54; however, the auxiliary belts 66 and 67 may be applied in any other configuration. The auxiliary belt 66 and 67 may be each tightly wound around the roller 54 and the pulley other than the roller 54 (not shown) so as not to sag.

In the paper sheet stacking mechanism of the present invention, the discharge position, from which the paper sheet transported from the transport unit is discharged to the gap between two adjacent vanes 52*b* of the stacking wheel 52, may be disposed at any position other than the position inward of the circular region defined by the tips of the vanes 52*b* of a stacking wheel 52 during the rotation of the stacking wheel 52. In a paper sheet stacking mechanism 50*d* according to still another modification illustrated in FIG. 12, the discharge position, from which the paper sheet transported from the transport unit is discharged, is disposed outward from the circular region defined by the tips of the vanes 52*b* of the stacking wheel 52 during the rotation of the stacking wheel 52. The configuration of the paper sheet stacking mechanism 50*d* according to the modification illustrated in FIG. 12 will now be described in detail. The common component between the paper sheet stacking mechanism 50*d* according to the modification illustrated in FIG. 12 and the paper sheet stacking mechanism 50 illustrated in FIG. 6 is denoted by the same reference numerals. Redundant descriptions will not be referred.

Figure 12:
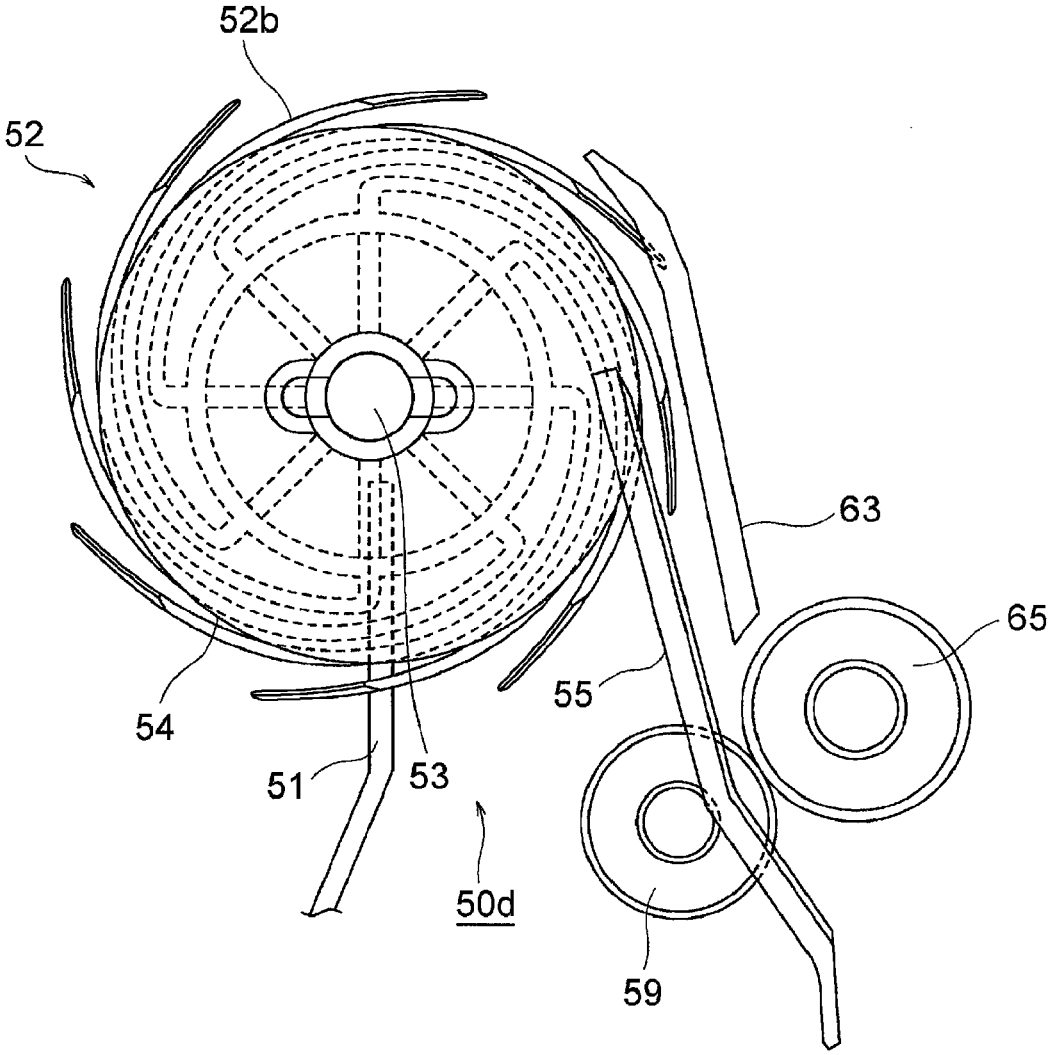
FIG. 12 is a side view of still another configuration of a paper sheet stacking mechanism according to the embodiment of the present invention.

In the paper sheet stacking mechanism 50*d* according to the modification illustrated in FIG. 12, a pair of guide rollers 59 and 65 is configured to function as a transport unit for transporting a paper sheet to the gap between two adjacent vanes 52*b* of a stacking wheel 52. In such a configuration, the paper sheet transported from a transport unit 18 passes through the nip portion formed between the guide rollers 59 and 65, is transported in the upward direction in FIG. 12, and enters the gap between the vanes 52*b* of the stacking wheel 52. In addition, guide units 55 and 63 are provided to limit the paper sheet passing through the nip portion formed between the guide rollers 59 and 65 and being transported until the gap between the vanes 52*b* of the stacking wheel 52 within a predetermined deviation amount. In the paper sheet stacking mechanism 50*d* according to the modification illustrated in FIG. 12, the outer periphery of the roller 54 is in contact with a pulley, etc. (not shown) for example, that is configured to be driven by a drive motor (not shown) so that the roller 54 is configured to be rotated counterclockwise together with the rotation of the pulley, etc. in FIG. 12. The roller 54 is rotatable at a greater angular velocity than that of the angular velocity of the stacking wheel 52. Specifically, the roller 54 is rotatable at two to ten times the angular velocity of the stacking wheel 52, for example. More specifically, the roller 54 is rotatable at 2.8 times the angular velocity of the stacking wheel 52, for example. In such a configuration, the paper sheet transported from the transport unit 18 and passing through the nip portion formed between the guide rollers 59 and 65 travels through the gap between the guide units 55 and 63, and then enters the gap between two adjacent vanes 52*b* of the stacking wheel 52.

Also in the paper sheet stacking mechanism 50*d* according to the modification illustrated in FIG. 12, the roller 54 has a frictional member that is composed of rubber, etc. for example, and that is disposed on the outer periphery of the roller 54. In addition, the roller 54 is rotatable about a shaft 53 at a greater angular velocity than that of the stacking wheel 52, so that, the paper sheet received in the gap between two adjacent vanes 52*b* of the stacking wheel 52 is thrust into the back of the gap (toward the roots of the vanes 52*b*) by the friction generated between the paper sheet and the outer periphery of the roller 54. Even after the rear end edge of the paper sheet is discharged from the nip portion formed between the guide rollers 59 and 65, the drawing force of the roller 54 can hold the paper sheet in the gap between the vanes 52*b* of the stacking wheel 52 regardless of the resilience of the paper sheet, inhibiting the pushing-back of the paper sheet from the stacking wheel 52 before the contact of the front end edge of the paper sheet with the guide member 51.

In the paper sheet stacking mechanism of the present invention, the stacking wheel 52, the roller 54, the first auxiliary roller 60, and the second auxiliary roller 62 may be disposed at any positions other than those illustrated in FIG. 5. Various exemplary layouts of the stacking wheel 52, the roller 54, the first auxiliary roller 60, and the second auxiliary roller 62 in the paper sheet stacking mechanism of the present invention will now be described with reference to FIG. 13. For example, a paper sheet stacking mechanism as illustrated in FIG. 13(*a*) may include a single stacking wheel 52 and a single roller 54 but no first auxiliary roller 60 or second auxiliary roller 62. In the paper sheet stacking mechanism, the roller 54 faces a single transport belt 56 that is tightly installed around pulleys 58 and that is in partial contact with the outer periphery of the roller 54. A paper sheet stacking mechanism as illustrated in FIG. 13(*b*) may include a single stacking wheel 52, a single roller 54, and only a single first auxiliary roller 60 or a single second auxiliary roller 62 may be disposed at the side of the stacking wheel 52 and the roller 54. A paper sheet stacking mechanism as illustrated in FIG. 13(*c*) may include a pair of right and left rollers 54 and a single stacking wheel 52 disposed between the rollers 54, but no first auxiliary roller 60 or second auxiliary roller 62.

A paper sheet stacking mechanism as illustrated in FIG. 13(*d*) may include a pair of right and left stacking wheels 52 and a single roller 54 disposed between the stacking wheels 52, but no first auxiliary roller 60 or second auxiliary roller 62. A paper sheet stacking mechanism as illustrated in FIG. 13(*e*) may include a pair of right and left stacking wheels 52, a single roller 54 disposed between the stacking wheels 52, and right and left second auxiliary rollers 62 disposed outward from the respective stacking wheels 52, but no first auxiliary roller 60.

A paper sheet stacking mechanism as illustrated in FIG. 13(*f*) may include a pair of right and left stacking wheels 52 and a pair of right and left rollers 54 disposed between the stacking wheels 52, but no first auxiliary roller 60 or second auxiliary roller 62. A paper sheet stacking mechanism as illustrated in FIG. 13(*g*) may include a pair of right and left stacking wheels 52, a pair of right and left rollers 54 disposed outward from the respective stacking wheels 52, and a first auxiliary roller 60 disposed between the stacking wheels 52, but no second auxiliary roller 62.

Similarly to the roller 54 of the paper sheet stacking mechanism 50 illustrated in FIG. 5, each roller 54 of the paper sheet stacking mechanisms illustrated in FIG. 13(*a*) to FIG. 13(*g*) is also disposed at the side of the corresponding stacking wheel 52 and is coaxially aligned with the corresponding stacking wheel 52. Each roller 54 is rotatable about the shaft 53 at a greater angular velocity than that of each stacking wheel 52. In each configuration, the paper sheet received in the gap between two adjacent vanes of the stacking wheel 52 is thrust into the back of the gap (toward the roots of the vanes 52*b*) by the friction generated between the paper sheet and the outer periphery of the roller 54. Even after the rear end edge of the paper sheet is discharged from the discharge position between the roller 54 and the transport belt 56, the drawing force of the roller 54 can hold the paper sheet in the gap between the vanes 52*b* of the stacking wheel 52 regardless of the resilience of the paper sheet, inhibiting the pushing-back of the paper sheet from the stacking wheel 52 before the contact of the front end edge of the paper sheet with the guide member 51.

It should be noted that the transport unit for transporting a paper sheet to the gap between two adjacent vanes 52*b* of the stacking wheel 52 may be composed of any component other than the at least one transport belt 56 facing the corresponding roller 54 in the paper sheet stacking mechanisms illustrated in FIG. 13(*a*) to FIG. 13(*g*). It is to be understood that the invention is not limited to these specific embodiments. Specifically, in place of the at least one transport belt 56, a plurality of counter rollers 64, for example, may be used as a transport unit for transporting a paper sheet to the gap between two adjacent vanes 52*b* of the stacking wheel 52 even in the paper sheet stacking mechanisms illustrated in FIG. 13(*a*) to FIG. 13(*g*).

The invention claimed is:

1. A paper sheet stacking mechanism comprising:

a stacking unit configured to stack paper sheets in a stacked manner therein;

a stacking wheel configured to transport paper sheets one by one to the stacking unit, the stacking wheel comprising a base fixed to a shaft and rotatable in a first rotational direction about the shaft and a plurality of vanes outwardly extending from the outer periphery of the base in a second rotational direction opposite to the first rotational direction of the base, the stacking wheel being configured to repeatedly transport a paper sheet received in a gap between two adjacent vanes among the plurality of vanes to the stacking unit;

a roller disposed adjacent to the stacking wheel so as to be coaxial with the stacking wheel; and a transport unit configured to face the roller and transport a paper sheet to a gap between two adjacent vanes among the plurality of vanes of the stacking wheel, the transport unit being located such that a discharge position, from which a paper sheet gripped between the roller and the transport unit is discharged, is disposed outward from the outer periphery of the base of the stacking wheel and inward of a circular region defined by tips of the plurality of vanes of the stacking wheel during rotation of the stacking wheel, when viewed from the axial direction of the shaft, wherein a nip is formed between the transport unit and the roller, the nip transporting the paper sheet for receipt by a gap that is positioned between two adjacent vanes of the stacking wheel, and the roller is freely rotatable about the shaft and is configured to be rotated together with movement of the transport unit that is in contact with the roller, such that the roller is rotated about the shaft at a greater angular velocity than the angular velocity of the stacking wheel.

2. The paper sheet stacking mechanism according to claim 1, further comprising a frictional member disposed on the outer periphery of the roller.

3. The paper sheet stacking mechanism according to claim 2, wherein the frictional member comprises rubber.

4. The paper sheet stacking mechanism according to claim 1, wherein the transport unit comprises a transport belt in partial contact with the outer periphery of the roller.

5. The paper sheet stacking mechanism according to claim 4, wherein the roller is configured to be rotated together with circulation of the transport belt.

6. The paper sheet stacking mechanism according to claim 4, wherein the transport belt is located so as to limit a deviation of a paper sheet being transported until a gap between two adjacent vanes among the plurality of vanes of the stacking wheel within a predetermined deviation amount.

7. The paper sheet stacking mechanism according to claim 1, wherein the transport unit comprises a counter roller in partial contact with the outer periphery of the roller.

8. The paper sheet stacking mechanism according to claim 7, wherein the counter roller in partial contact with the outer periphery of the roller comprises a plurality of rollers.

9. The paper sheet stacking mechanism according to claim 7, further comprising a guide unit for limiting a deviation of a paper sheet being transported until a gap between two adjacent vanes among the plurality of vanes of the stacking wheel within a predetermined deviation amount.

10. The paper sheet stacking mechanism according to claim 1, further comprising an auxiliary belt wound around the roller, wherein the transport unit comprising a transport belt in partial contact with the auxiliary belt, the auxiliary belt being in partial contact with the outer periphery of the roller, and a paper sheet gripped between the auxiliary belt wound around the roller and the transport belt of the transport unit is discharged from the discharge position.

11. The paper sheet stacking mechanism according to claim 10, wherein part of the auxiliary belt is in partial contact with the outer periphery of the roller and the other part of the auxiliary belt sags from the outer periphery of the roller.

12. The paper sheet stacking mechanism according to claim 1, further comprising an auxiliary belt wound around the roller, wherein the transport unit comprising a counter roller in partial contact with the auxiliary belt, the auxiliary belt being in partial contact with the outer periphery of the roller, and a paper sheet gripped between the auxiliary belt wound around the roller and the counter roller of the transport unit is discharged from the discharge position.

13. The paper sheet stacking mechanism according to claim 1, wherein a minimum distance is within a range of 1.5 mm to 3.0 mm between the tip of each vane of the stacking wheel and the surface of an adjacent vane.

14. The paper sheet stacking mechanism according to claim 1, wherein the angle is within a range of 150° to 180° between a straight line from the tip of each vane of the stacking wheel to the shaft of the stacking wheel and a straight line from the root of the vane attached to the base to the shaft of the stacking wheel.

15. The paper sheet stacking mechanism according to claim 1, wherein at least two said stacking wheels are arranged coaxially, a first auxiliary roller is disposed between the at least two said stacking wheels so as to be coaxial with the at least two stacking wheels, and the first auxiliary roller has a diameter greater than the diameter of the base of each of the at least two stacking wheels.

16. The paper sheet stacking mechanism according to claim 15, wherein the frictional coefficient between the outer periphery of the roller and a paper sheet to be stacked in the stacking unit is greater than the frictional coefficient between the outer periphery of the first auxiliary roller and the paper sheet.

17. The paper sheet stacking mechanism according to claim 1, wherein at least two stacking wheels are arranged coaxially, second auxiliary rollers are respectively disposed outward from the at least two stacking wheels, the second auxiliary rollers being coaxial with the at least two stacking wheels.

18. The paper sheet stacking mechanism according to claim 17, wherein each of the second auxiliary rollers has a diameter not greater than the diameter of the roller.

19. A paper sheet handling apparatus comprising the paper sheet stacking mechanism according to claim 1.

* * * * *